US011112209B2

(12) United States Patent
Overstreet et al.

(10) Patent No.: US 11,112,209 B2
(45) **Date of Patent: *Sep. 7, 2021**

(54) FIREARM WITH COMBINATION EXTENSIBLE SHOULDER STOCK AND RECEIVER TUBE

(71) Applicant: 22 Evolution LLC, Boonville, MO (US)

(72) Inventors: John L. Overstreet, Fayette, MO (US); Brett Eckelkamp, Fulton, MO (US); Scott Greer, Sedalia, MO (US); Tyson Bradshaw, Boonville, MO (US)

(73) Assignee: 22 Evolution LLC, Columbia, MO (US)

( * ) Notice: Subject to any disclaimer, the term of this patent is extended or adjusted under 35 U.S.C. 154(b) by 85 days.

This patent is subject to a terminal disclaimer.

(21) Appl. No.: 16/733,505

(22) Filed: Jan. 3, 2020

(65) Prior Publication Data

US 2020/0141690 A1 May 7, 2020

Related U.S. Application Data

(62) Division of application No. 16/137,833, filed on Sep. 21, 2018, now Pat. No. 10,551,144.

(60) Provisional application No. 62/613,196, filed on Jan. 3, 2018.

(51) Int. Cl.
*F41C 23/14* (2006.01)
*F41A 3/84* (2006.01)

(52) U.S. Cl.
CPC ..... *F41C 23/14* (2013.01); *F41A 3/84* (2013.01)

(58) Field of Classification Search
CPC ..... F41C 23/14; F41C 23/04; F41C 23/20; F41C 23/06; F41C 23/22; F41A 3/84
USPC ..... 42/71.01–75.1
See application file for complete search history.

(56) References Cited

U.S. PATENT DOCUMENTS

| | | | |
|---|---|---|---|
| 3,267,601 | A | 8/1966 | Roy |
| 6,651,371 | B2 | 11/2003 | Fitzpatrick et al. |
| D603,013 | S | 10/2009 | Fitzpatrick et al. |
| 8,087,193 | B2 | 1/2012 | Kincel |
| 8,381,427 | B2 | 2/2013 | Nill |
| 8,397,414 | B2 | 3/2013 | Walters |
| 8,464,458 | B2 | 6/2013 | Chvala |
| 8,656,622 | B2 | 2/2014 | Peterson et al. |
| 8,720,099 | B1 | 5/2014 | Sisk |
| 8,800,189 | B2 | 8/2014 | Fitzpatrick et al. |
| 8,955,245 | B2 | 2/2015 | Chvala |

(Continued)

*Primary Examiner* — Michael D David
(74) *Attorney, Agent, or Firm* — Dinsmore & Shohl LLP

(57) ABSTRACT

A combination receiver tube and adjustable stock for a firearm having a receiver. The receiver tube extends rearwardly from the receiver and includes a series of recessed locations formed along a length extending surface thereof, each of the recesses further including an ascending surface extending at an acute angle from the recessed location to an outer surface of the tube. The stock has a forward opening communicating with an open interior so that the stock is slidably mounted over the receiver tube to support axial movement of the stock relative to the tube. The stock includes a lug which is biased for seating within a first selected one of the recessed locations and, upon counter-biasing the lug to unseat from the recessed location, permitting the stock to be rearwardly extended from the receiver tube across consecutive recessed locations.

19 Claims, 22 Drawing Sheets

(56) References Cited

U.S. PATENT DOCUMENTS

| | | | | |
|---|---|---|---|---|
| 9,488,435 | B1 | 11/2016 | Roberts et al. | |
| 9,551,549 | B1 | 1/2017 | Chvala | |
| D781,392 | S | 3/2017 | Zayatz et al. | |
| 9,625,232 | B2 | 4/2017 | Gomez | |
| D792,936 | S | 7/2017 | Eitan et al. | |
| 9,746,281 | B2 | 8/2017 | Wilson et al. | |
| 9,766,034 | B2 | 9/2017 | Huang et al. | |
| D798,984 | S | 10/2017 | Roberts et al. | |
| 10,551,144 | B2 * | 2/2020 | Overstreet | F41C 23/14 |
| 2013/0305579 | A1 | 11/2013 | Ward et al. | |
| 2018/0073835 | A1 | 3/2018 | Saltzman | |
| 2018/0080736 | A1 | 3/2018 | Olsen | |
| 2018/0120055 | A1 | 5/2018 | Silverman et al. | |
| 2018/0156568 | A1 | 6/2018 | Troy et al. | |
| 2019/0204044 | A1 * | 7/2019 | Overstreet | F41C 23/14 |

* cited by examiner

FIREARM WITH COMBINATION EXTENSIBLE SHOULDER STOCK AND RECEIVER TUBE

CROSS REFERENCE TO RELATED APPLICATIONS

The present application is a divisional of U.S. Ser. No. 16/137,833 filed Sep. 21, 2018. The '833 applications claims the priority of provisional application U.S. Ser. No. 62/613,196 filed Jan. 3, 2018, the contents of which are incorporated by reference in their entirety.

FIELD OF THE INVENTION

The present invention is directed to an extensible shoulder/butt stock and receiver tube associated with a firearm. More specifically, the present invention teaches a combination extensible shoulder stock and receiver tube for permitting adjustment of the stock in order adapt an overall length of the firearm to a user

BACKGROUND OF THE INVENTION

The prior art is documented with examples of receiver extensions, such as incorporated into a firearm in communication with a rear extending shoulder or butt stock. The receiver tube is also termed a buffer tube and functions to allow the user to attach a stock to the rifle as well as to encapsulate the buffer and buffer spring, letting the bolt carrier ride back and forth to eject the spent brass and load the next round.

As is also known, the buffer and buffer spring are housed within the buffer tube and are crucial elements for the AR's cyclic action. The buffer is the contact point for the bolt carrier to move rearward within the buffer tube and the spring resides in the most aft position of the assembly. When the buffer spring recoils, it pushes the buffer and bolt carrier forward, thus loading the next round of ammunition and closing the bolt for the next shot.

Walters, U.S. Pat. No. 8,397,414, teaches an M4/AR15 adjustable and multi-position receiver extension with an add-in part (see buttstock pre-adjustment block 10). Chvala, U.S. Pat. No. 8,955,245, teaches another version of an adjustable stock for a firearm and which, of note, includes a movable member provided with locking structure mounted on the stock for selective engagement with lock receiving structure on the buffer tube for locking the stock in various axial adjustment positions along the buffer tube.

U.S. Pat. No. 9,664,476, to Robinson (RMDI, LLC), teaches an adjustable firearm stock with first and second selector bodies configured within a position selector device integrated into interface between the receiver tube and displaceable stock (see FIGS. 3-4), this differing in numerous respects from the proposed design.

US 2018/00807636 to Olsen teaches an adjustable buttstock which may be attached to a buffer tube with a plurality of position slots. The adjustable buttstock may include a body slidably attached to the buffer tube, a butt attached to the body, and a lever assembly rotatably attached to the body.

Also noted is the Magpul AR15/M4 Enhanced Receiver Extension which includes a plurality of apertures configured in spaced apart fashion upon an extending underside thereof. The receiver tube is secured to a rear end of the lower receiver and so that a projecting end of the receiver tube is seated within an interior of a shoulder stock. A trigger style lever is integrated into an interior window of the shoulder stock and, when depressed, permits the stock to be repositioned along the length of the receiver tube over several positions by reseating a pin integrated into the lever within one of the spaced apart underside apertures configured within the receiver tube.

SUMMARY OF THE INVENTION

The present invention discloses a combination buttstock with extensible receiver tube associated with a firearm, the combination providing smoother outward retracting action of the receiver tube relative to the telescopically attached buttstock than is available in prior designs. A lever arm having a limited range of pivotal displacement extends from a location of the buttstock and includes an engagement lug or pin, which can further exhibit any of a flat or chamfered/tapered edge and which is adapted to seat within a selected one of a plurality of axially spaced apart apertures defined in the receiver or buffer tube.

The spaced apart apertures can each further exhibit any type of curved, sloping or other non-planar configuration (such as in one non-limiting variant being arranged at 30° to the horizontal) which, in one non-limiting variant and upon exerting a rearward pulling force on the buttstock, causes the lever lug to slidably displace outwardly from each successive aperture (and without having to maintain depression on the lever arm in a continuation rearward extending motion) and in order to adjust an overall length of the shoulder stock relative to the receiver tube.

Versions of the present invention include the spaced apart apertures in the buffer tube and engaging lever/lug of the shoulder/butt stock being configured along any of an underside or either of left/right sides to provide ease of slidable adjustment. A side configuration of the spaced apart buffer tube apertures can further interact with a press-pin configuration in which a portion located on a first of opposite sides of the stock is pressed inwardly in order to unseat outwardly a spring loaded pin supported on the other side from engagement with a selected engaged aperture, the stock then being retracted outwardly with the inward spring bias of the pin counteracted by the rearward extending slope or chamfer associated with each consecutive aperture in order to quickly extend the shoulder stock.

In one particular variant, a back screw associated with the lever mount limits the pivotal range of the lever, subject to removal of the screw, to prevent the receiver tube from being pulled free from the stock. Additional features include the provision of a stop screw at an interface location established between the receiver tube and stock for limiting a range of rearward travel of the stock. In this manner, and once a user determines a preferred customized length, installation of this set screw prevents the stock from being overextended beyond a certain point.

As will be additionally described in reference to the detailed description, the definition of the term "stock" as provided herein is further understood to include any of a shoulder or buttstock, such as commonly associated with firearms with barrels sixteen inches or longer, as well as pistol braces which can include, without limitation, firearms with barrels less than sixteen inches.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

With reference to the various selected and non-limiting embodiments of FIGS. 1-24, the present invention discloses a combination buttstock with extensible receiver tube associated with any type of firearm or pistol, such combination providing smoother outward retracting action of the receiver tube relative to the telescopically attached shoulder stock or buttstock (along with optional pistol brace variant being hereinafter collectively referred to as a "stock") than is available in prior designs. As will be further described with succeeding reference to each of the illustrated embodiments, the present invention provides the ability to arrange the spaced apart seating or recessed apertures on either or both sides or an underside of the buffer tube. An associated lever or push pin arrangement may be further configured within the supporting stock and, in combination, provides for unseating of an engaging pin or lug from within a selected aperture of the tube in order to axially reposition the stock, such as outwardly and without having to hold the lever in an open position, as further provided by a chamfered or sloped patterning of a surrounding rim to each spaced apart aperture which allows for quick extension of the stock.

Figure 1:
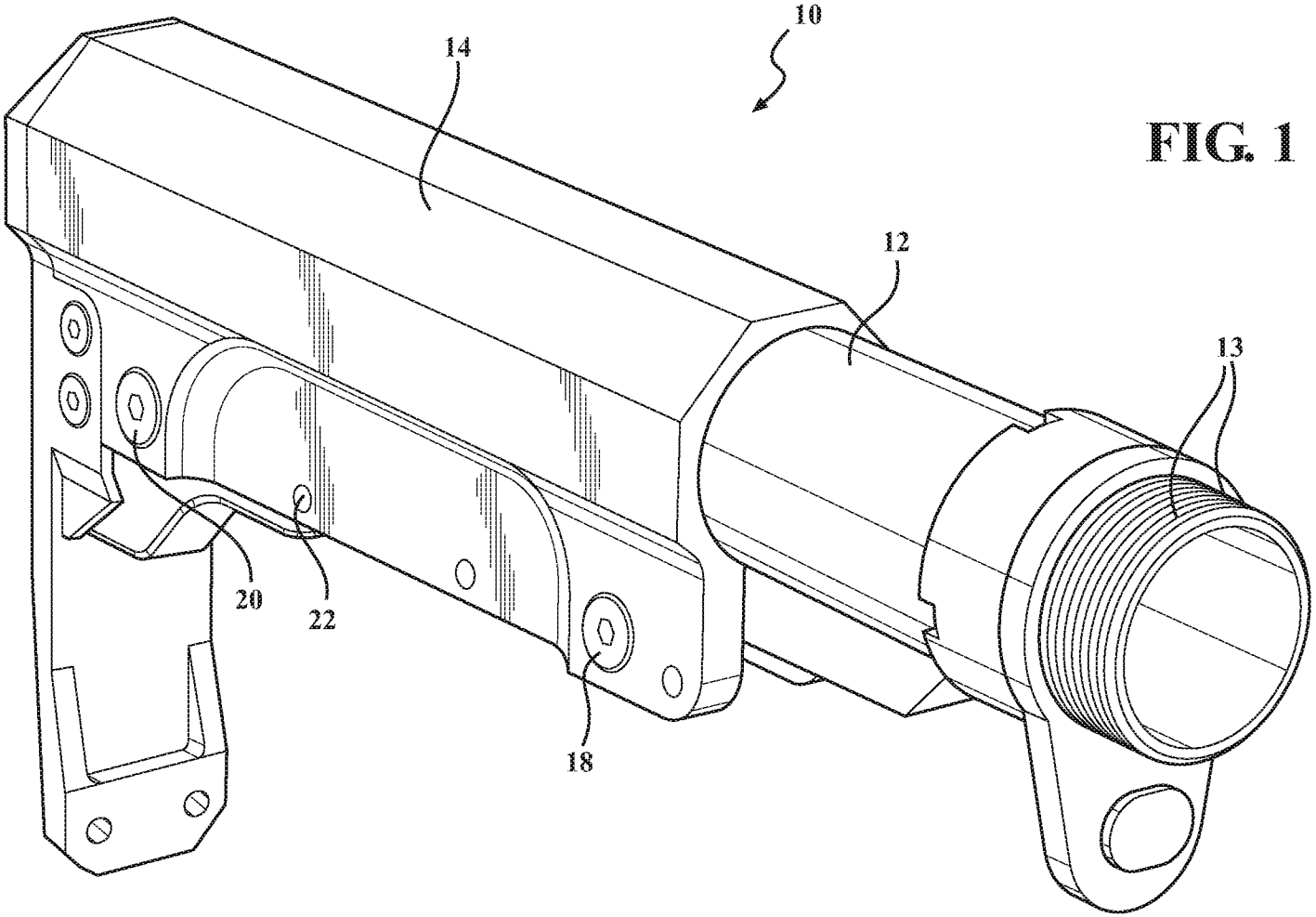
FIGS. 1-2 present a pair of front and rear rotated perspective illustrations of the receiver tube and buttstock according to one non-limiting variant of the present invention.
Figure 2:
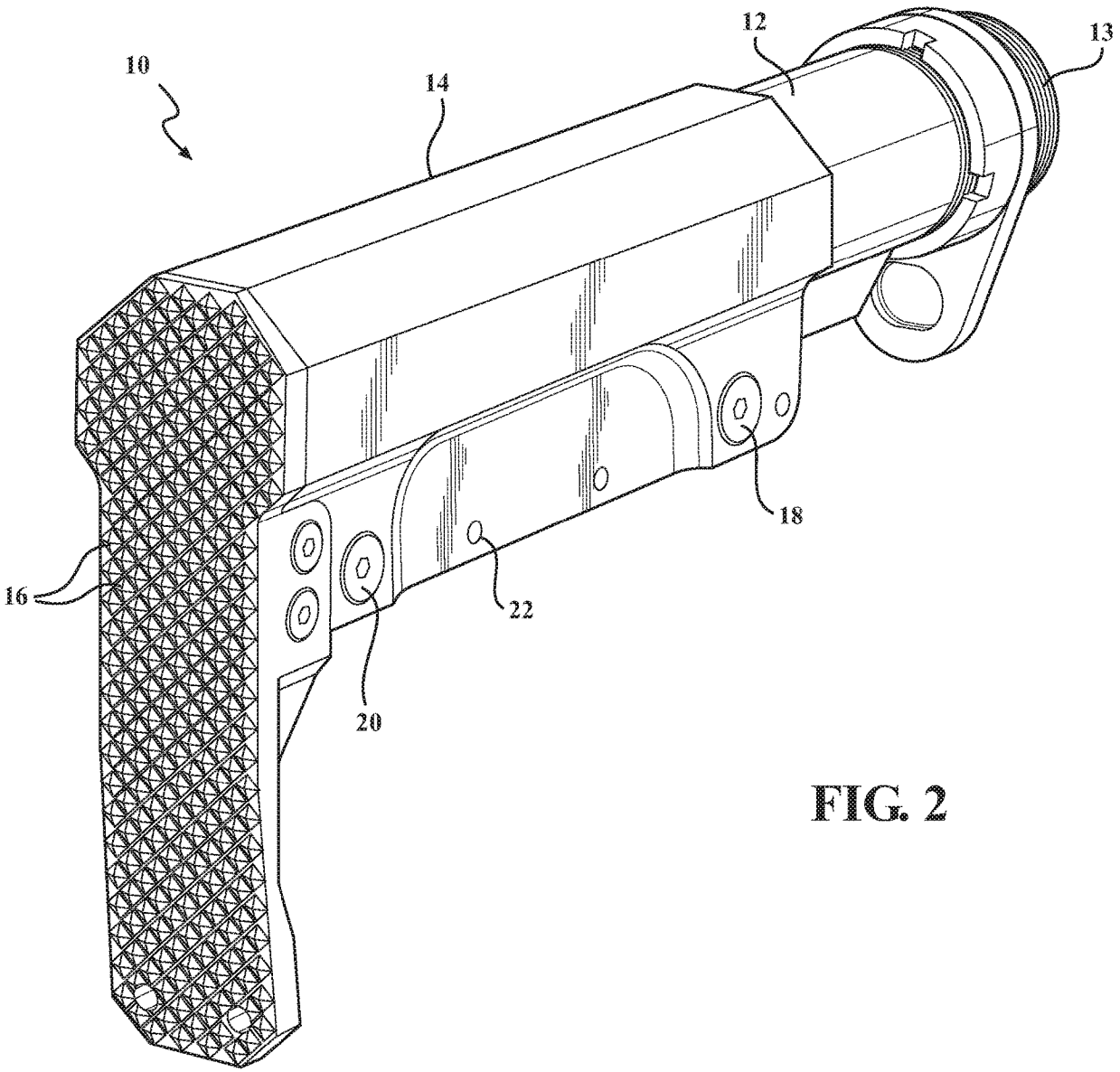
Figure 3:
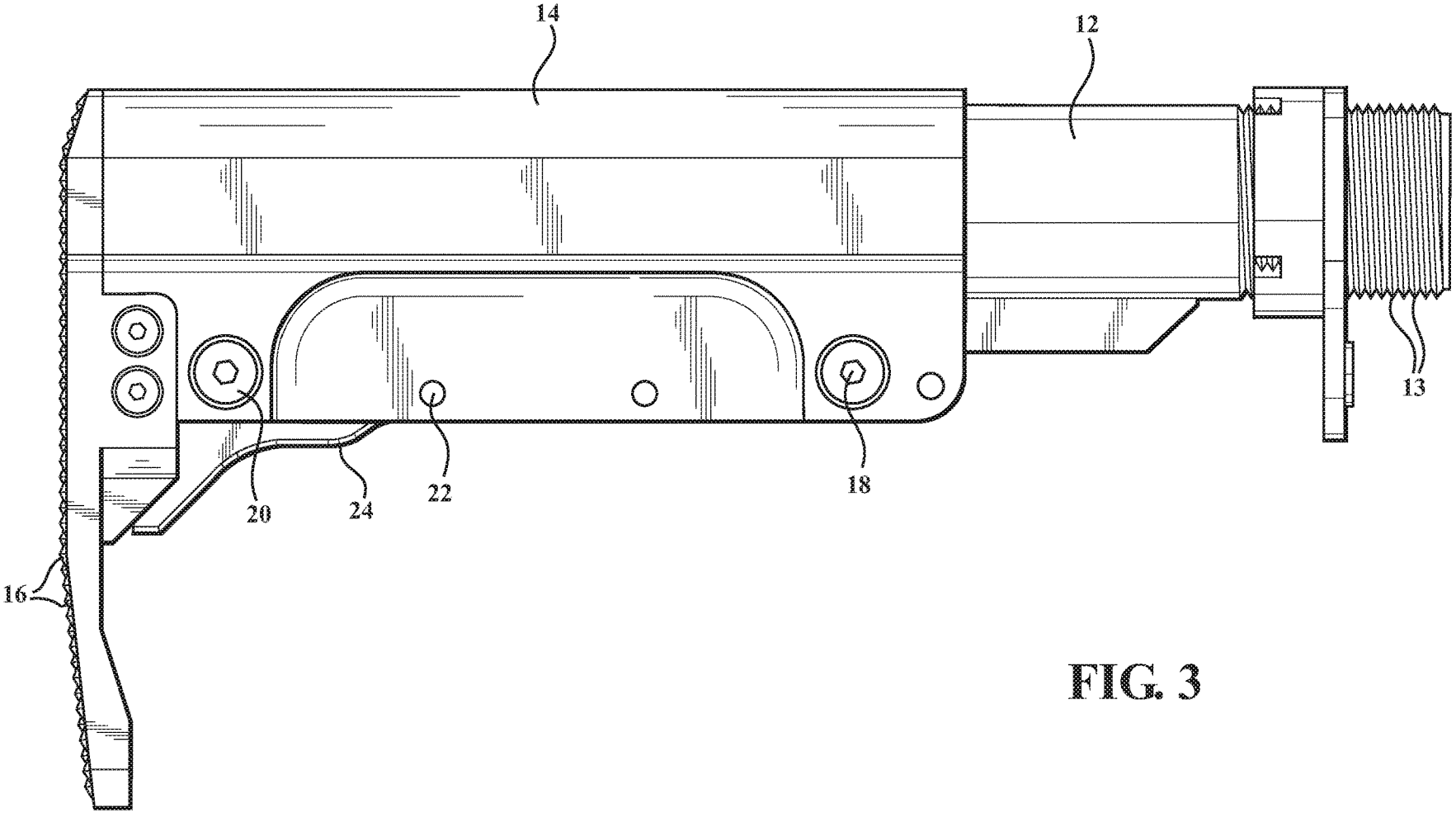
FIG. 3 is a right side plan view of the receiver tube and buttstock of FIG. 1.
Figure 4:
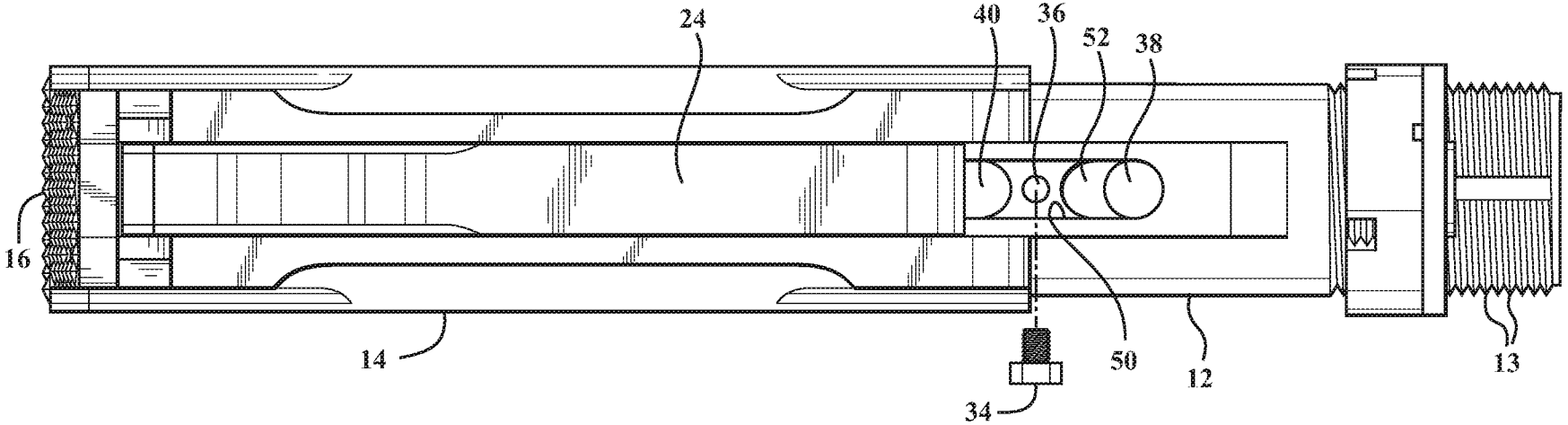
FIG. 4 is an underside view of FIG. 3 depicting the chamfer surface associated with a rearmost aperture within the buffer tube underside.

Referring initially to FIGS. 1-2, presented are a pair of front and rear rotated perspective illustrations, generally at 10, of a receiver tube 12 and stock 14 according to one non-limiting variant of the present invention. For purposes of the present description, the versions of the tube 12 and stock 14 are non-limiting and are envisioned to encompass incorporation into any type of elongated firearm (rifle, carbine, etc.) as well as utilizing in any shortened variant not limited to a pistol/handgun or other single-handed platform.

To this end, the definition of the term "stock" as provided herein is, as previously referenced, further understood to include any of a shoulder or buttstock, such as commonly associated with firearms with barrels sixteen inches or longer, as well as pistol braces (see subsequent FIGS. 25-26) which can include, without limitation, firearms with barrels less than sixteen inches in overall length. For purpose of the description and claims, the recitation of the term "stock" will further encompass (without limitation) any of the varying configurations shown throughout the drawings, as well as any other stock/brace design which is integrated into a one hand or two handed firearm platform.

For purposes of better understanding, a quick, primer of the actual difference between an AR-15 rifle, pistol and short-barreled rifle; is provided as follows.

When it comes to AR-15's, if the barrel is shorter than 16" it falls into 3 categories.

- Short-Barreled Rifle—Has a buttstock, requires ATF approval. All accessories allowed.
- Pistol—No buttstock, but can use an arm stabilizing brace, no ATF approval required. Can't use vertical grips.
- Firearm—Rarely Used, no butt stock, can use an arm stabilizing brace, no ATF approval required, but overall length over 26" and can use a vertical grip.

Given the above explanation, the receiver tube 12 is configured to be seated within a mating interior profile defined by the stock 14, with the tube and stock, along with the other components of the receiver and firearm (regardless of type) being constructed of a suitable gun metal (steel with mixed carbon) of desired percentages and in order to yield desirable properties.

The features of the receiver tube 12 (also termed a buffer tube and including any of the several variants depicted in the present invention) each include a cross sectional profile which is configured for seating within a mating and forward accessible interior of the stock 14 (again including and not limiting as to any type of buttstock, shoulder stock or other length adjustable grips supported upon the buffer tube. As further previously described, the receiver/buffer tube 12 includes a plurality of forward end threads, these shown by example at 13 in FIGS. 1-4 for the initial version 12 of the receiver tube but again replicated for each subsequent version, and for installing to a rear interior threaded end of the firearm receiver (not shown) and so that the buffer tube and buffer spring components (not shown) are supported therein for assisting in the reciprocating cycling motion of the bolt carrier group (also not shown) of the firearm to which the stock is attached.

The rotated rear perspective of FIG. 2 further depicts a knurled or other mounting rear surface, see patterning at 16, to which can be secured a suitable stock pad or other cushioning support (not shown). As further shown, a pair pins 18 and 20 are engaged within receiving holes or locations 18 and 20 indicated in the stock 14, with a pivot point location depicted at 22 for the associated and underside supported lever 24 (a modified example of which is further described at 22' in FIG. 18A and which can be pivotally mounted to the underside of the stock 14 so that an upwardly biased pin or lug (at 24 in FIGS. 14-16) is seated within a selected recess or aperture configured within an underside of the received buffer tube 12.

Figure 13:
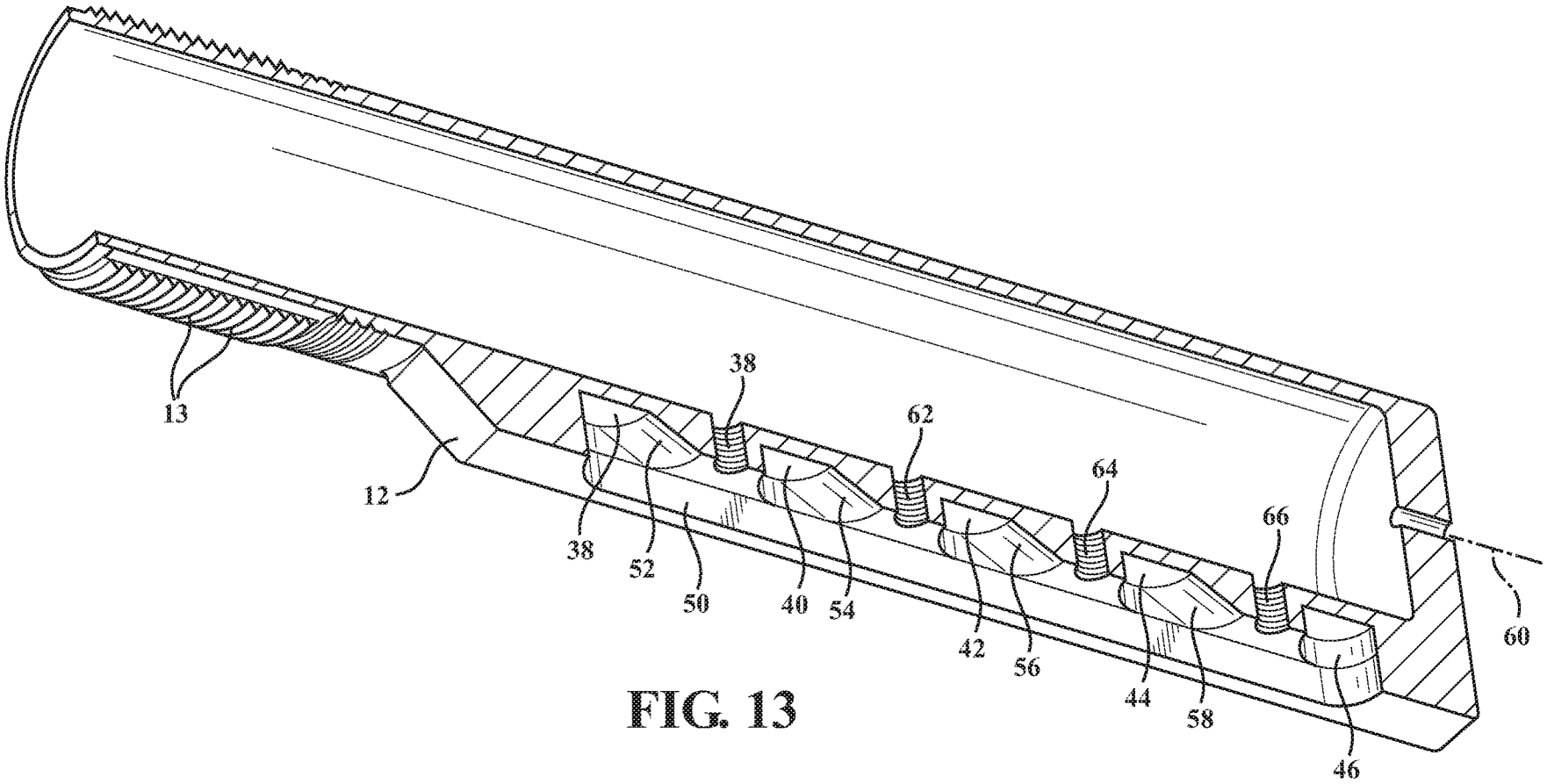
FIG. 13 is a slightly rotated underside perspective of the buffer tube depicted in lengthwise cutaway of FIG. 12 and depicting the three dimensional flared pattern of the individual sloping chamfer recesses associated with each of the recess apertures.
Figure 14:
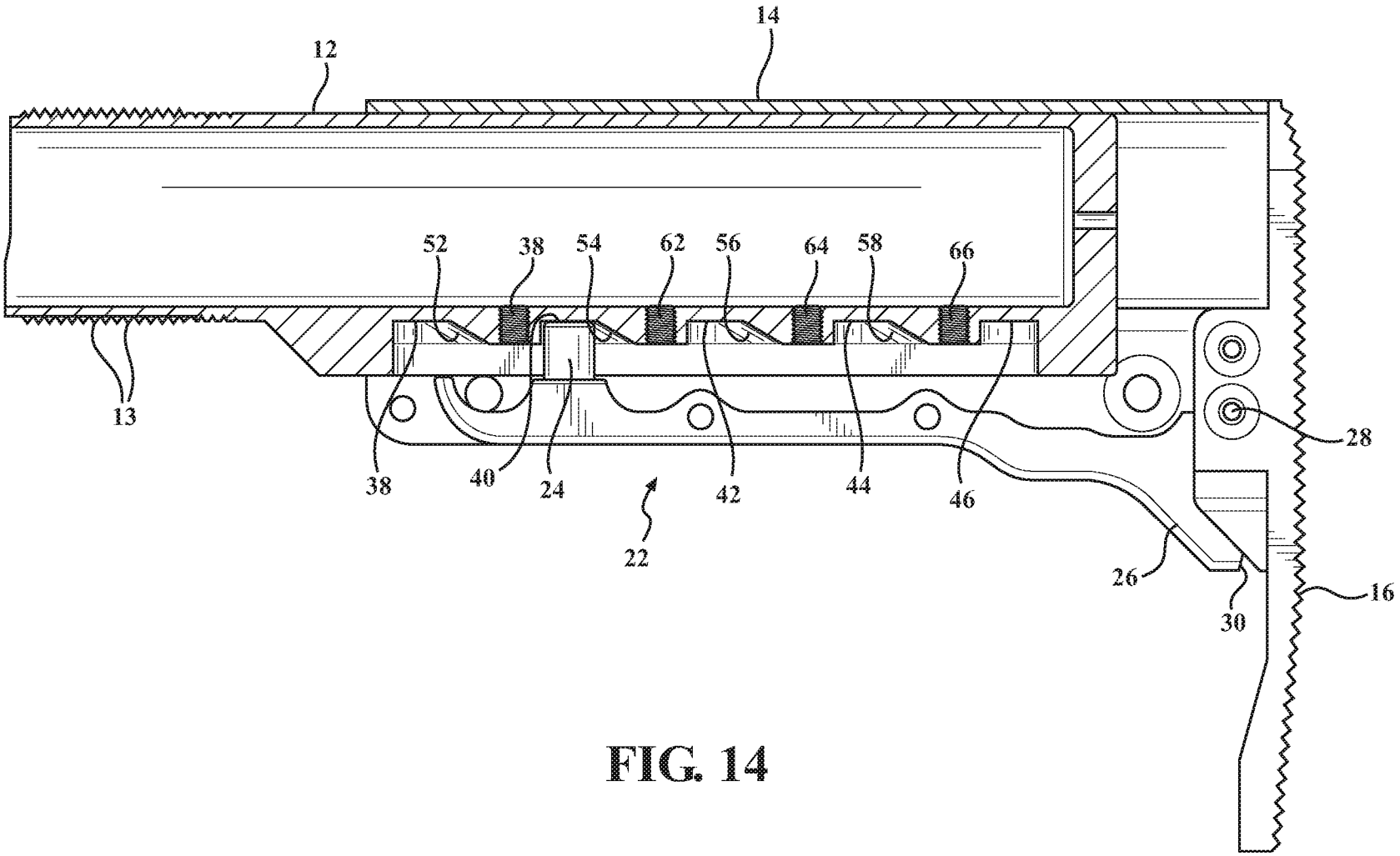
FIG. 14 is a side plan view of the assembled receiver tube and buttstock as shown in FIGS. 1-3, in length cutaway depiction for better showing the seating action of the lever lug for engaging within a selected one of the underside seating and recess apertures with lead-in sloping profiles.
Figure 15:
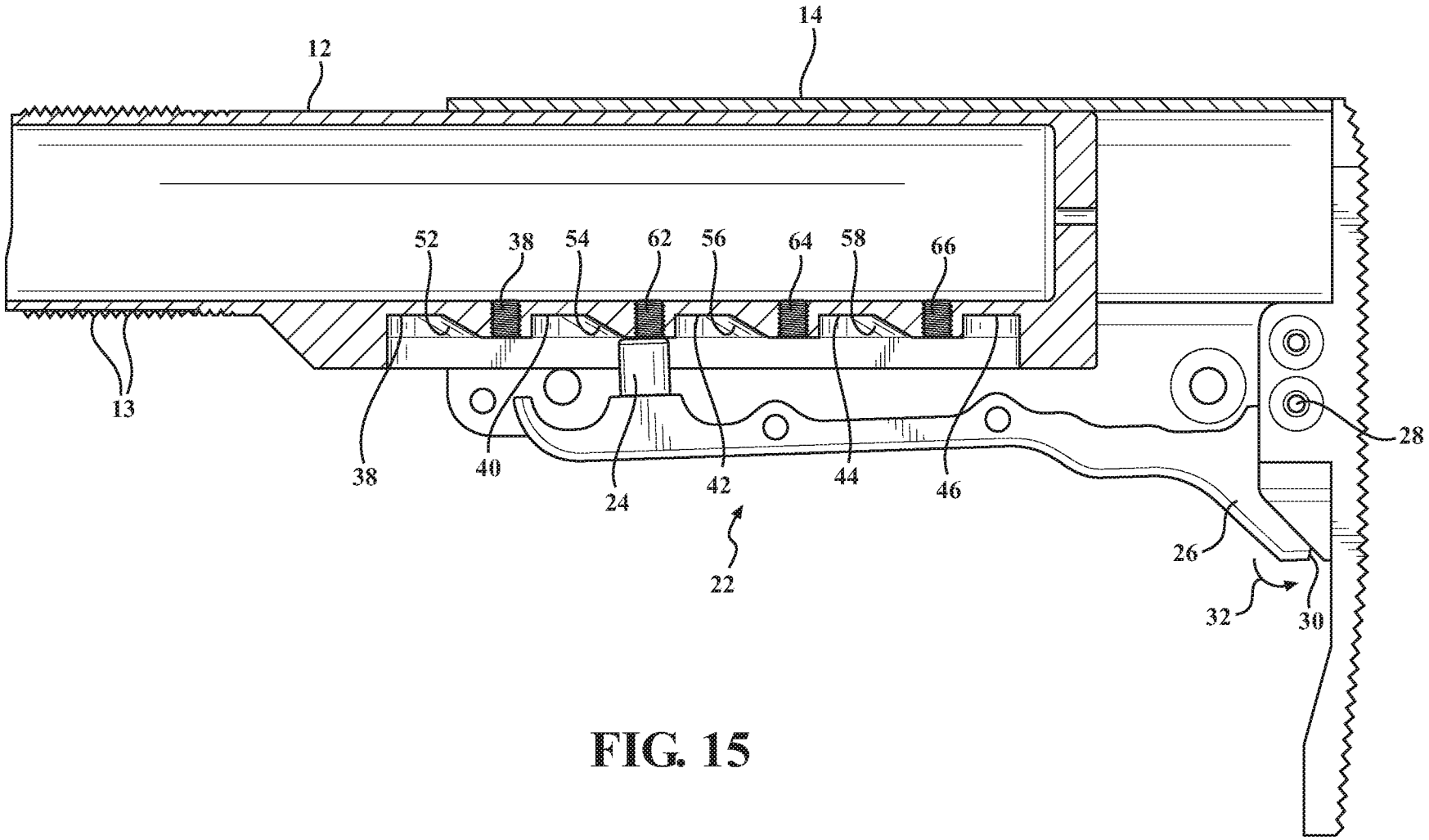
FIG. 15 is a succeeding illustration of the lever and engaging lug of FIG. 14 in an intermediate disengaged position relative to a selected seating recess aperture during inter-extension of the tube relative to the stock.
Figure 16:
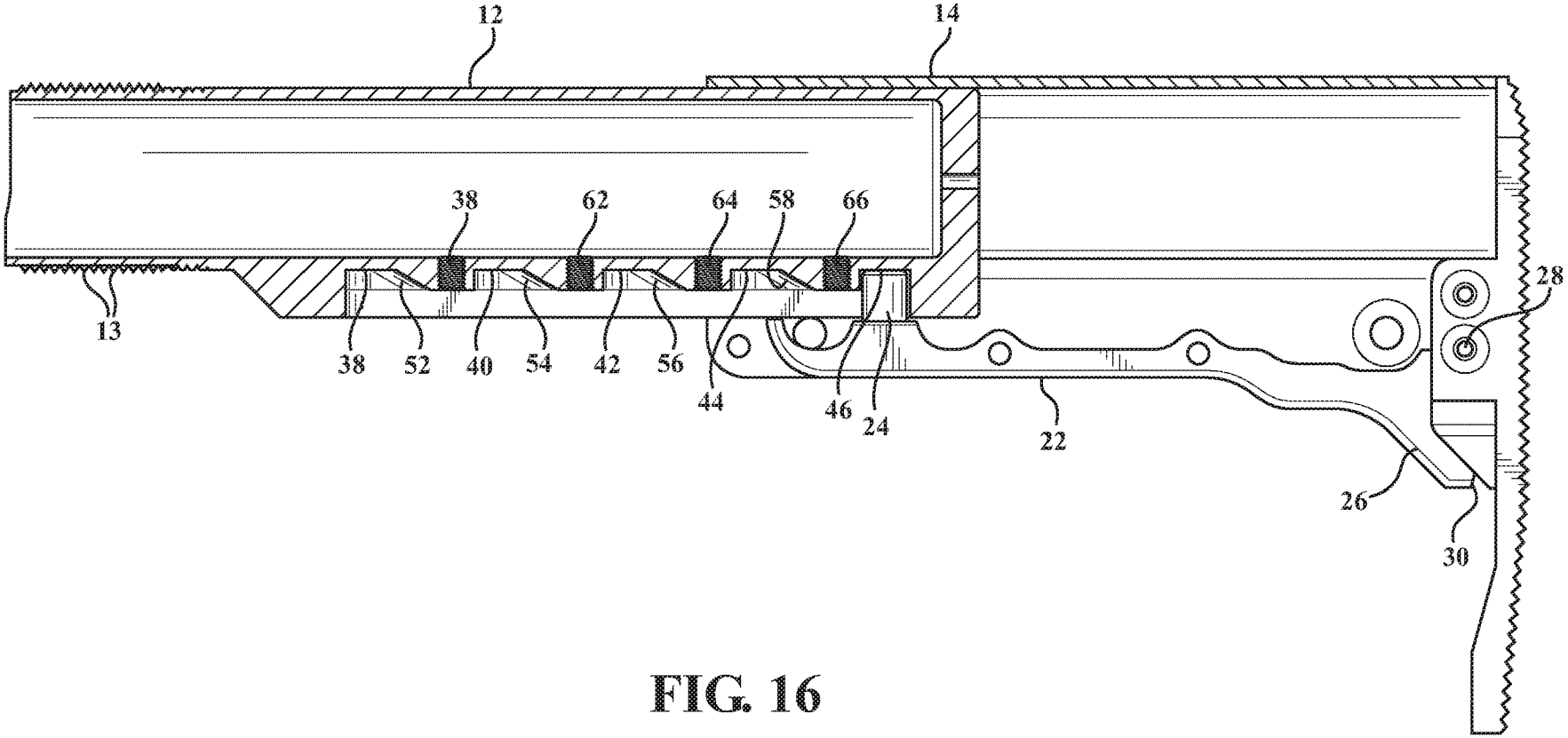
FIG. 16 is a further succeeding illustration to FIG. 15 and illustrating the stock in a rearward most and fully extended position relative to the buffer tube.
Figure 17:
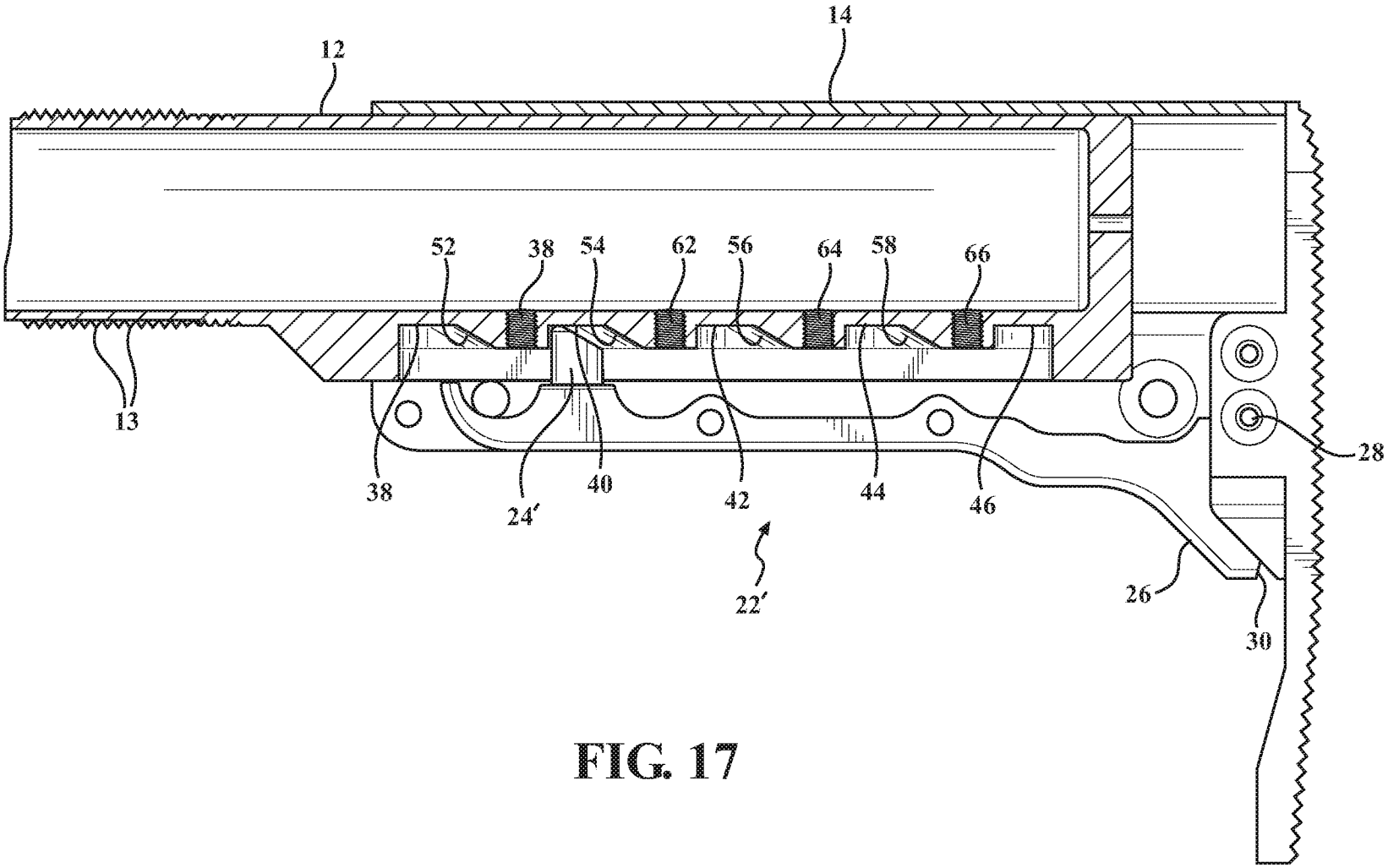
FIG. 17 is a side plan view of an assembled receiver tube and buttstock similar to FIG. 14, again in length cutaway depiction and showing the seating action of an alternately configured lever lug with a chamfered end profile for engaging within a selected one of the underside seating and recess apertures with lead-in sloping profiles.
Figure 18:
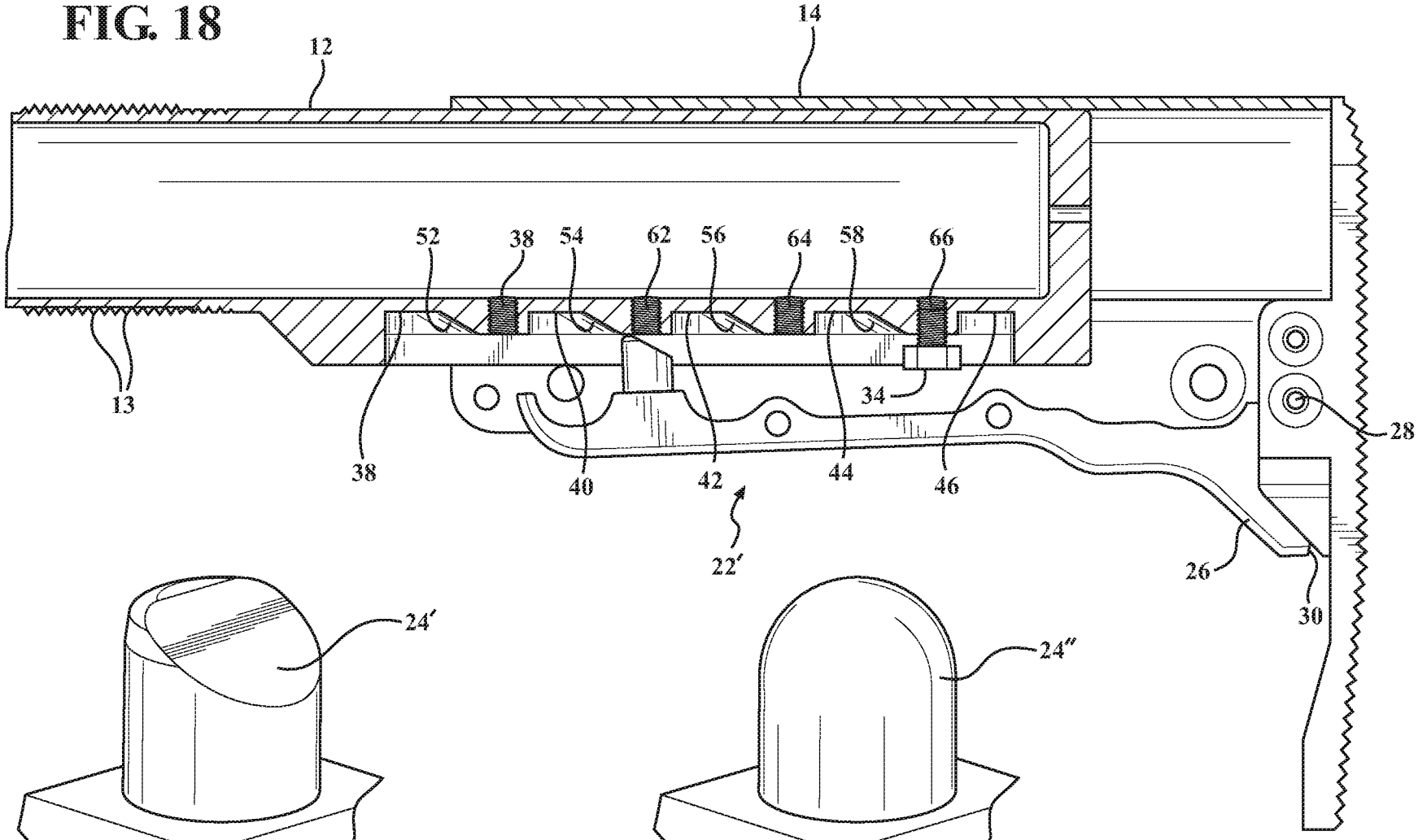
FIG. 18 is a succeeding illustration of the lever and engaging lug of FIG. 17 in an intermediate disengaged position relative to a selected seating recess aperture during inter-extension of the tube relative to the stock.
Figure 20:
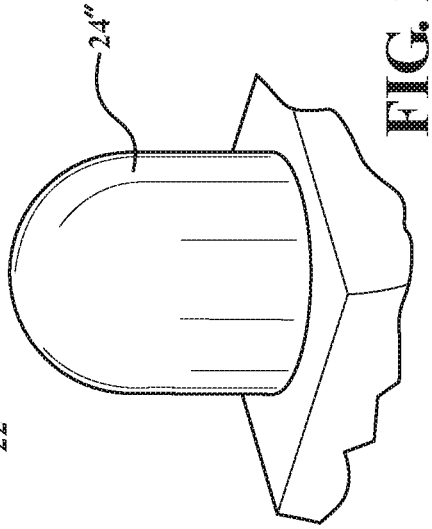
FIG. 20 is a similar partial perspective to FIG. 19 of the lever supported lug/pin according to a further variant and depicting a rounded/dome shaped end profile.
Figure 19:
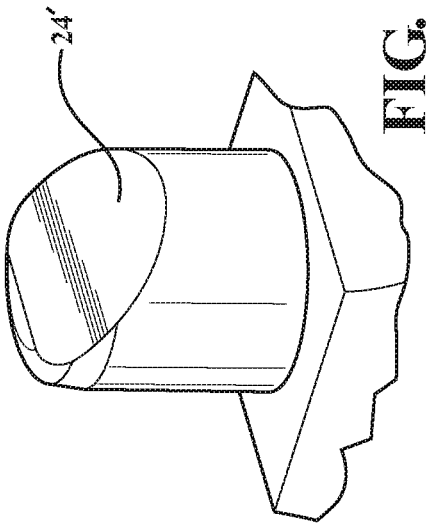
FIG. 19 is a partial perspective of the lever supported seating lug or pin of FIGS. 17-18 and exhibiting the end chamfer profile.
Figure 18A:
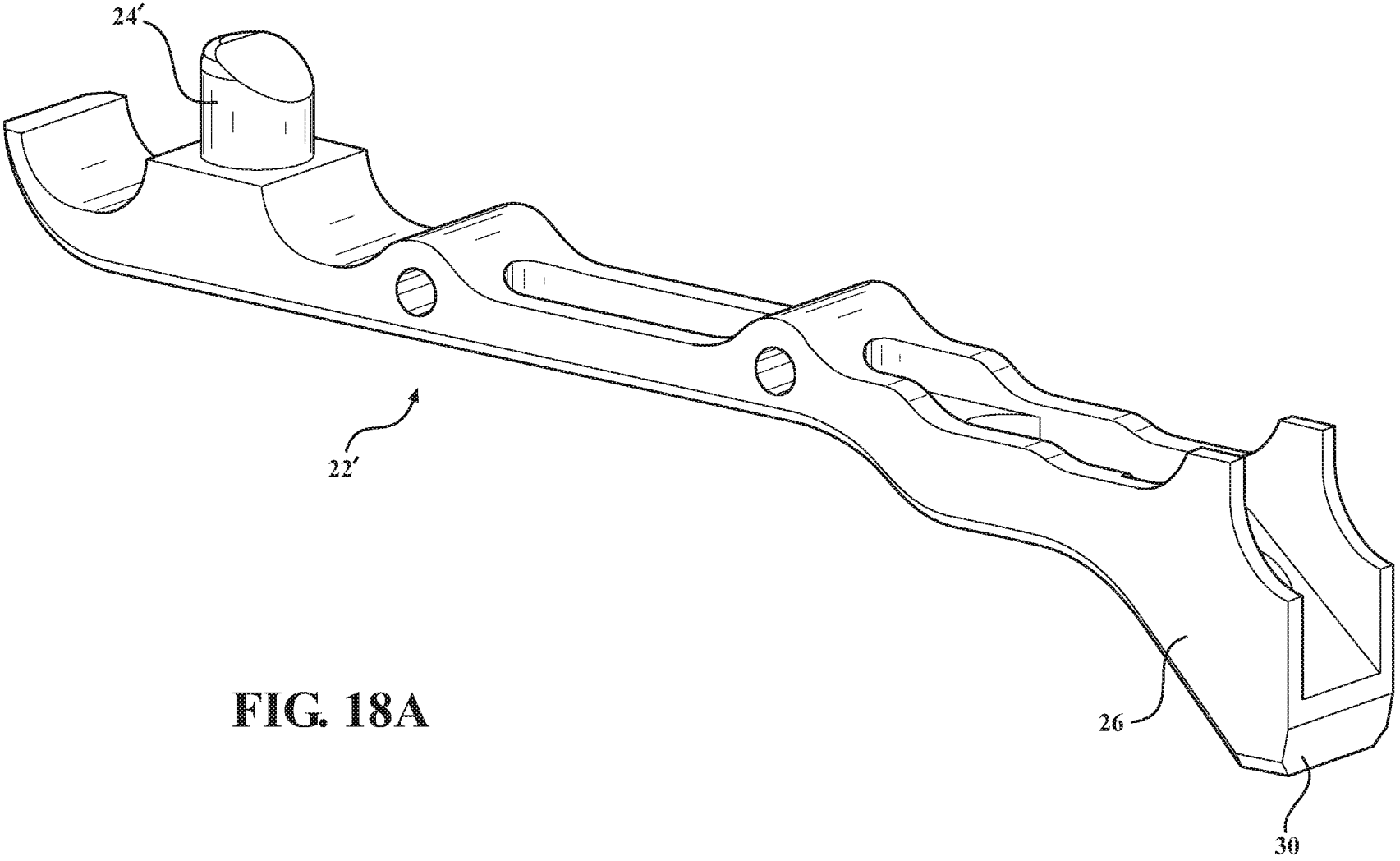
FIG. 18A is perspective illustration of the lever and lug configuration of FIGS. 17-18 detached from the stock.

The lever 22 of FIGS. 14-16, as well as further shown at 22' in FIGS. 17-18A, has an elongated body with a base end 26 connected in a limited pivotal fashion to a rear end location of the stock 14 (via a back screw or stop pin received in aperture 28. A rear lower profile 30 of the base mounting portion of the lever permits a limited range of pivotal motion (see directional arrow 32 in FIG. 15) of the lever about pivot point 22 (and relative to the crosswise extending back screw) and so that the seating lug (24 in FIGS. 14 and 24' in FIG. 17) of the lever is permitted a limited degree of counter biased displacement in and out of contact relative to selected axially spaced apertures. FIG. 19 is a partial perspective of the lever supported seating lug or pin of FIGS. 17-18 and exhibiting the end chamfer profile again at 24', with FIG. 20 providing a similar partial perspective to FIG. 19 of the lever supported lug/pin according to a further variant and depicting a rounded/dome shaped end profile 24", these co-acting with the sloping profile of the individual receiver tube underside apertures (reference to FIGS. 10-17 described below) to facilitate extension of the stock 14 from the buffer/receiver tube 12 without the requirement of holding down the lever once the associated lug has been initially unseated from a selected aperture.

Referencing again FIGS. 1-4, in combination with collective views of FIGS. 10-18, the underside spaced apart apertures in the receiver tube 12 of the initial embodiment, each exhibit a rearward slope (such as in one non-limiting variant being arranged at 30° relative to a horizontal axis extending through the receiver tube) and which, upon exerting a rearward pulling force on the supported stock 14, causes the lever lug 24 or 24' to slidably displace outwardly from each successive aperture in a ratchet type motion (and without having to maintain depression on the lever arm 22 or 22' in a continuation rearward extending motion) this in order to adjust an overall length of the stock relative to the receiver/buffer tube. A back screw, such as depicted at 34 in FIG. 4, can be associated with the lever mount and which engages with a forward most positioned screw hole 36 in the tube underside to limit the pivotal range of the lever and, subject to removal of the screw, to prevent the receiver tube from being pulled free from the stock.

Figure 11:
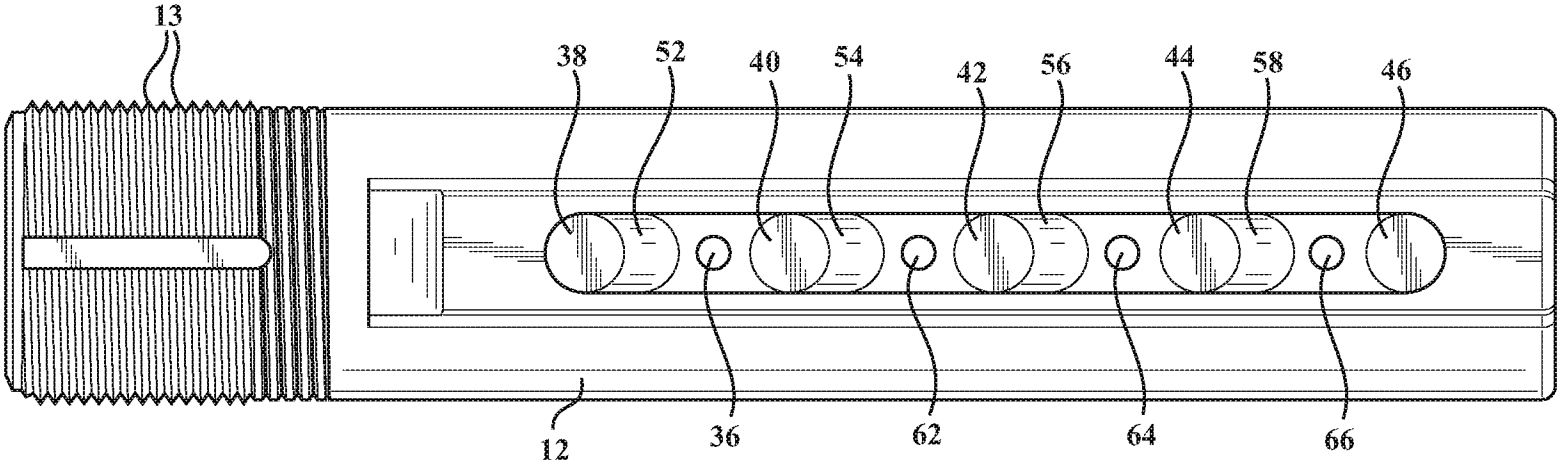
FIG. 11 depicts an underside view of the buffer tube again similar to FIG. 4 and removed from the stock.
Figure 12:
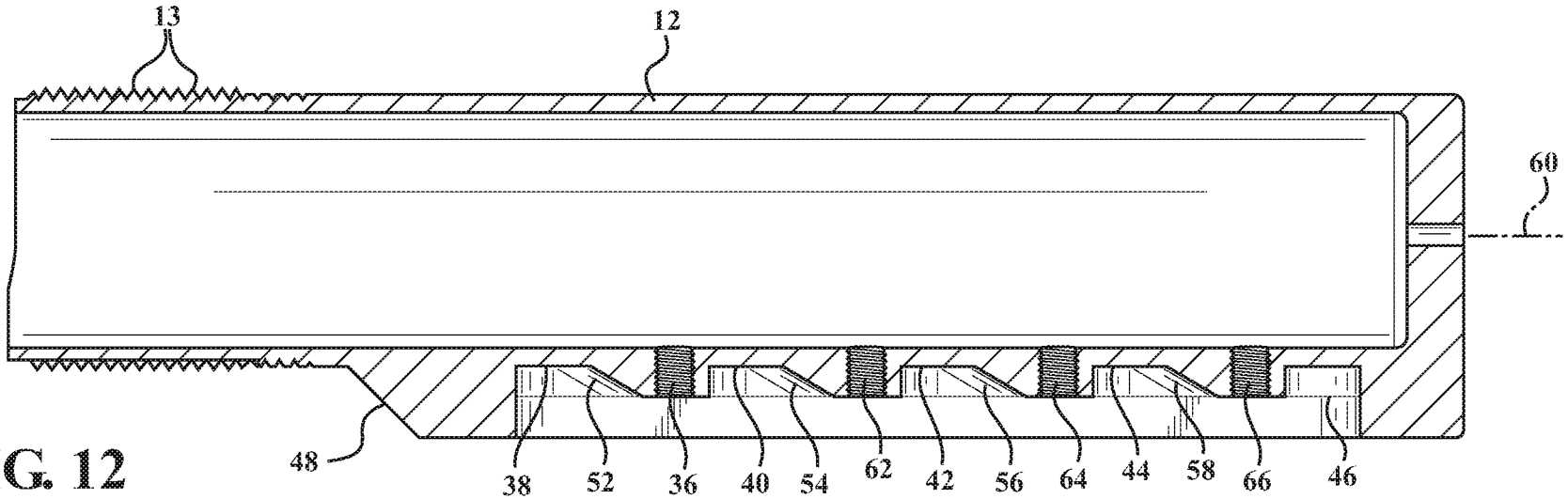
FIG. 12 is a linear side cutaway of the buffer tube of FIG. 11 and better depicting the individual sloping chamfer profiles of each recess aperture for facilitating outward displacement of the tube relative to the stock without the necessity of maintaining engagement on the lever supported lug or pin.

As best shown in FIGS. 11-13, a series of circular recesses or apertures 38, 40, 42 and 44 are depicted in axially spaced fashion along an underside of the receiver tube, with a further forward end (stop) aperture 46 also shown. The receiver tube 12 includes an underside profile embossment (see at 48) which defines an elongated underside perimeter slot 50 within which are arranged the circular recesses. Also shown in associated with each of the apertures 38, 40, 42 and 44 are dedicated lead in sloping surfaces, these identified at 52, 54, 56 and 58 respectively, each of which defining a flared skirt extending at an acute angle (e.g. in one non-limiting variant being in the range of 30°) relative to a horizontal axis 60 (FIG. 12) extending through the receiver tube 12 and in a direction towards the rear supporting stock 14 to which the tube 12 is telescopically engaged.

Additional interiorly threaded screw holes are provided at 62, 64 and 66 spaced from initially referenced screw hole 6, these being inter-spaced with the seating recesses 38, 40, 42, 44 and 46 and so that, upon a user establishing a desired maximum extension position of the stock, the stop screw (such as hex socket head screw 34 previously referenced in FIG. 4), is installed within a selected screw hole to prevent over extension of the stock (via engagement by the lever extending lug 24 or 24') when it is expanded relative to the receiver tube (see FIG. 18 installation of screw 34 in the last screw hole 66 in order to prevent disengagement of tube 12 from modified lever 22' and chamfered pin/lug 24'). Also, and with the assistance of the lead in sloping profiles 52, 54, 56, and 58), the lever 22' is further not able to be pivoted to a degree in which the lug 24' can displace out of contact with the end most located stop aperture 66.

As further described, the lever arm (both at 22 and 22') is provided having a limited range of pivotal displacement as it extends forwardly from an underside location of the stock 14 and includes the forward most lug (planar 24 as well as chamfered at 24') which is adapted to seat within a selected one of a plurality of axially spaced apart and underside facing receiver apertures 38-46 defined in the receiver tube.

Pins 18 and 20 are received in crosswise aperture locations in the buttstock 12 (shown again in FIGS. 1-3) and which assist in proper seating of either version 22 or 22' of the lever to ensure correct placement of the lug 24 or 24' within a selected aperture (the lug further again being contacted by the hex head screw 36 if installed to define a maximum extension position of the stock). Although not shown, a suitable leaf spring or other biasing element is provided either at the pivot point 22 for the lever or at another suitable location, in order to bias the lug in a direction toward the receiving tube underside.

Accordingly, the receiving tube design of the present invention, with the acute angled sloping of the lead in profiles to the individual underside receiving apertures, permits the stock to be slid out or extracted from the firearm receiver fixed receiver/buffer tube with the lever establishing a ratchet style motion as is successively glides over each successive recess profile and associated aperture pattern (such as which can include without limitation a 30° pattern), and such as to an outermost extended position (depicted in the progression of FIGS. 14-16) in which the lug 24 of the biased lever 22 is displaced from an initial seating aperture 40 (FIG. 14) to an end-most stop aperture 46 (FIG. 16). As also previously described, and when it is desired to retract or collapse the stock back over the receiver tube the lever 22 is triggered to unseat the lug 24 and the stock 14 is collapsed back over the tube 12.

FIGS. 17-18A correspond to FIGS. 14-16 and depict the chamfered end profile version of the lever 22' and lug 24'. FIG. 20 again depicts the dome shaped version 24" of the receiving lug, which is otherwise similarly functional to the lug configurations 24 and 24'. Without limitation, the lug design can be otherwise configured without departing from the scope of the invention.

Figure 5:
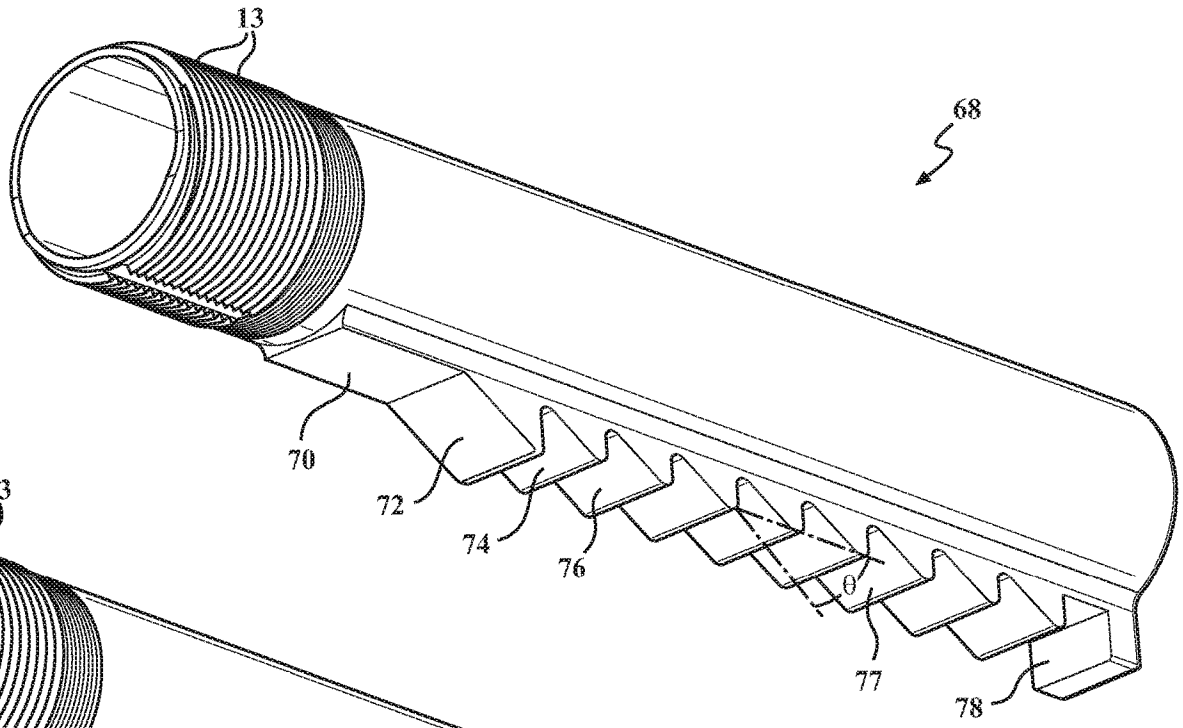
FIG. 5 is a perspective view of a detached buffer tube illustrating an underside stepped pattern according to an alternate variant of the present invention.

With reference now to FIG. 5, a perspective view is generally shown at 68 of a detached buffer tube illustrating an underside stepped pattern according to an alternate variant of the present invention. As further shown in FIGS. 5-9C, the present invention depicts several examples of non-limiting and alternate variations of the receiver tube (again initially depicted at 12 in FIG. 10 in the embodiment previously described) which can include a variety of different angles, slopes or other repeating profiles for interacting with the lever supported and biased lug/pin, examples of which again can include without limitation any of 24 (FIG. 14), 24' (FIG. 19) or 24" (FIG. 20), this in order to allow for easy extension of the supported stock without the need for maintaining disengagement of the lever once initially unseated from a selected aperture.

The version of the tube 68 in FIG. 5, as shown, includes a flattened underside 70 in proximity to the threaded end 13 which is secured to the firearm receiver. A plurality of wave-like underside projections or serrations are further shown at 72, 74, 76, et seq., each including a bottom surface extending at an acute angle (see angle Θ at 77) relative to the surface of the flattened underside 70 and away from the threaded end 13. An end most underside projection 78 is further illustrated at an opposite end of the tube 68 and can define an end-most stop extension for the lever lug 24/24'/24" of the supported stock 14. Although not further shown, secondary apertures can be configured into a redesign of the receiver tube 68 underside (such as shown at 38 and 62-66 in FIG. 10) for receiving stop screw 36.

Figure 6:
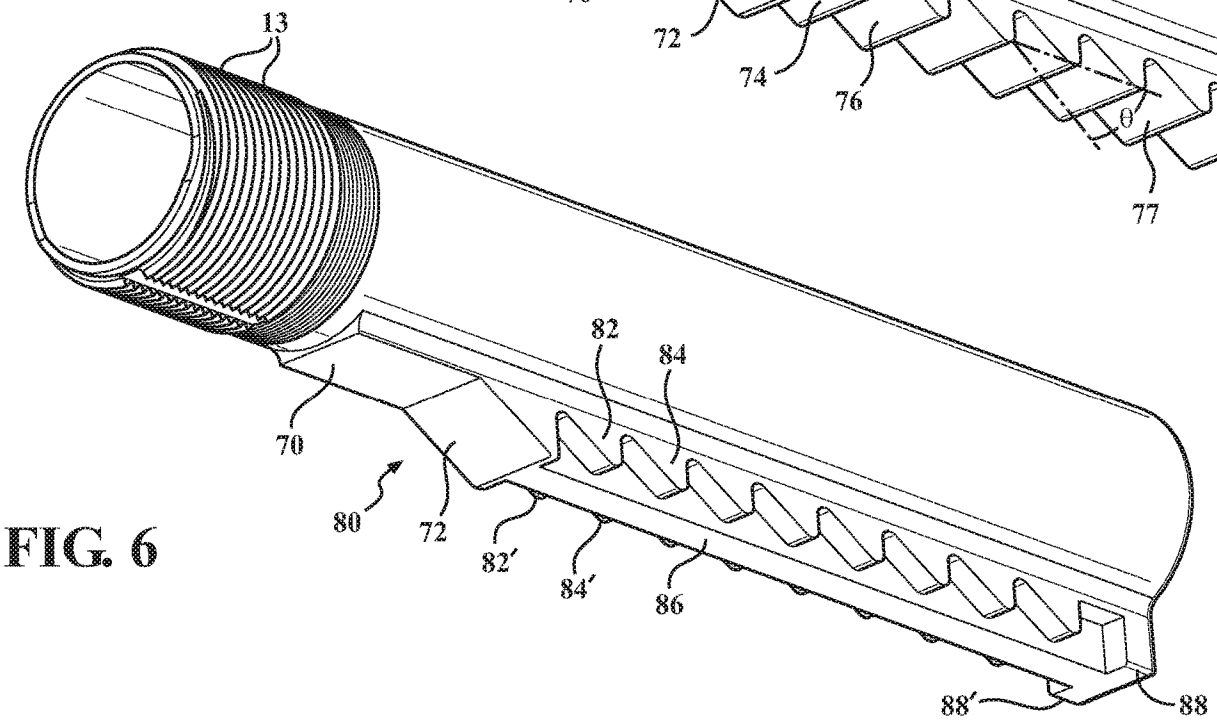
FIG. 6 illustrates a further variant of the buffer tube of FIG. 5 in which individual stepped patterns are provided along opposite underside edges and are separated by an extending middle portion.

FIG. 6 illustrates a further and related variant of the buffer tube of FIG. 5, generally at 80, and which again includes the flattened underside 70 and initial underside projection 72 depicted in FIG. 5. The succeeding stepped projections are represented in laterally split fashion, see pairs at 82/82', 84/84' et seq., along opposite underside edges and are separated by an extending middle portion or rail 86. A reconfigured end most underside projection is likewise laterally split at 88/88' by the intermediate rail 86. Although not shown, the stock supporting and biased lever can be easily modifiable to place a pair of side-by-side positioned lugs (not limited to any of those described or illustrated herein) in the particular arrangement of FIG. 6, and (as with the related variant of FIG. 5) which can support against any underside recess or depression resulting from the biased and exerted engagement and until the lever is actuated in a counter biasing direction in order to unseat the lug or lugs prior to extending the stock in a direction away from the threaded end connection of the tube to the receiver.

Figures 7A, 7B:
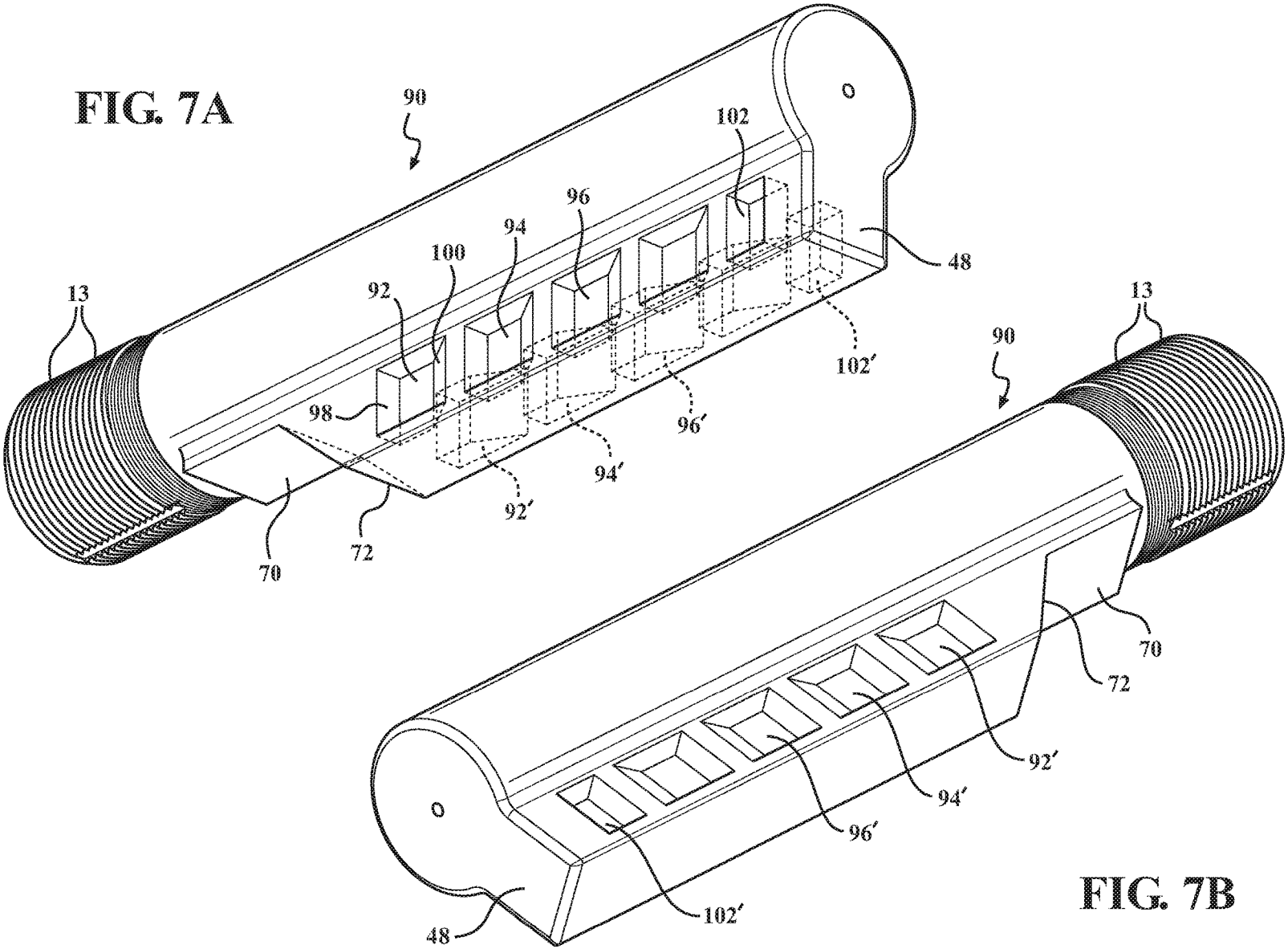
FIG. 7A is an illustration of a buffer tube according to a further embodiment and which depicts alternate configured recessed patterns along each of first and second extending base extending sides for receiving a side engaging lug or pin supported by the stock for permitting bi-directional adjustability of the buffer tube.
FIG. 7B is rotated perspective view of the buffer tube of FIG. 7A and depicting the recess pattern from an opposite side depicted in phantom in FIG. 7.

Proceeding to FIG. 7A an illustration of a further possible version of buffer tube is generally shown at 90, such having a similar profile to the original buffer tube configuration 12 and repeating the deepened underside profile depicted at 48, as well as including the flattened underside 70 and a similar ramped underside surface 72 corresponding in configuration to the initial ramped projection in each of FIGS. 5 and 6. Also depicted are configured recessed patterns, along each of first and second extending base extending sides (see at 92, 94, 96, et seq. for right side as well as at 92', 94', 96', et seq. for left side) for receiving an envisioned reconfiguration of the lever which can exhibit a side engaging lug or pin supported by the stock for permitting bi-directional adjustability of the buffer tube. This can further include the lever being reconfigured from that previously shown in FIG. 14 et seq., to be relocated from an underside to either of a right or left lower side location of the stock opposing the placement of the length extending apertures of the inward supporting tube. As further understood, the present invention contemplates the placement of the plurality of apertures on either or both of the right or left lower sides of the tube, such in combination with any end stock redesign which can include a suitably located lever.

As further shown for selected side recessed location 92 (also termed interchangeably as a recess aperture for purposes of consistency), each of the recess locations or apertures can include either of planar or arcuate ramped surfaces (see for example at 98 and 100) which extend to the lower central most depression (again at 92). A notched and end-most depression is further shown at 102 and can define an end most stop location for seating the lever pin/lug. As with the preceding embodiments, additional threaded apertures can be designed into one or more locations of the tube, with a hex head bolt or other fastener (see again at 36) being engaged at a given location in order to define a max extension stop location for the supported stock as it is rearwardly extended from the tube.

Proceeding to FIG. 7B, a rotated perspective view is shown of the buffer tube 90 in FIG. 7A and depicting the recess pattern from an opposite side depicted in phantom in FIG. 7. As previously described, the recess patterns can be provided on either or both sides of the receiver tube. These can also be provided with any acute/ramped planar or arcuate profiles in order to establish linearly spaced apart adjustment locations for spacing the rear stock from the receiver secured tube, such again enabling stock extension upon initial lever actuation in order to unseat the associated lug or pin, following which the rearward pulling of the stock provides for extension of the stock without the user having to hold open the lever lug. The design of the recessed pattern 92, 94, 96, et seq., with ramped surfaces 98/100 for selected pattern 92, further provides the user with the ability to both extend and retract the stock relative to the buffer tube once the lever lug is initially unseated.

Figures 8A, 8B:
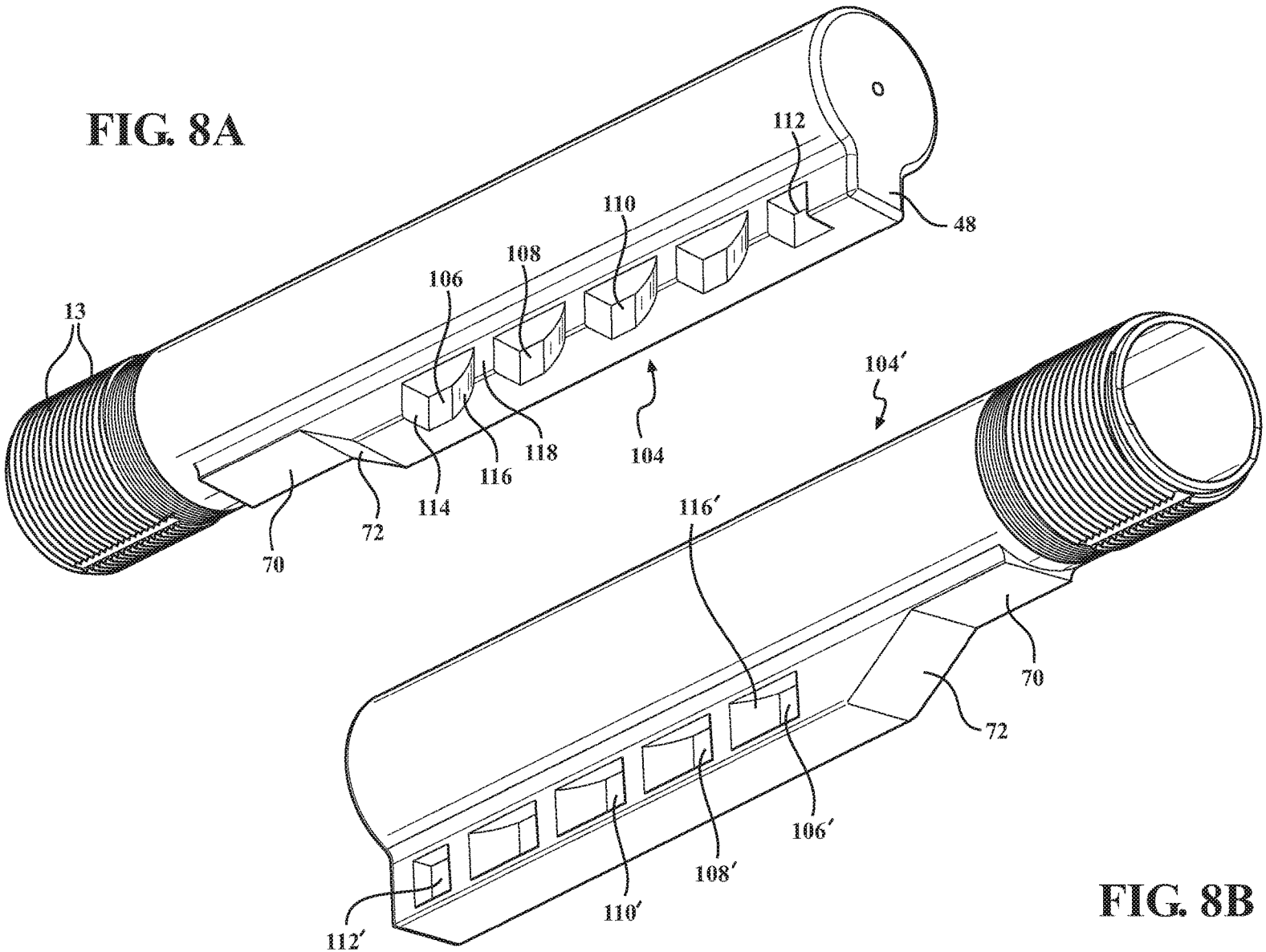
FIG. 8A is an illustration of a buffer tube exhibiting a further version of spaced apart recesses.
FIG. 8B is a rotated perspective view of a buffer tube similar to that shown in of FIG. 8A and depicting an arrangement of recesses along an opposite/single extending side

FIG. 8A is an illustration, at 104, of a buffer tube which is similar to that shown at 90 and exhibiting a further version of spaced apart recesses, these depicted on the right lower side of the tube and referenced at 106, 108, 110, et seq. to an end most notched recess 112 (as with 102 in FIG. 7A this having planar and perpendicular interconnecting side and base surfaces). Viewing selected recess 106, ramped surfaces 114 and 116 are shown. The descending ramped surface 114 can be planar (leading to the bottom most recess surface again identified at 106), with the opposite edge and ascending surface 116 further envisioned as being any of planar or non-planar, such as arcuate as depicted leading back to the outer side edge surface (at 118) of the lower length projection of the tube.

FIG. 8B is a rotated perspective view of a buffer tube 104' similar to that shown in of FIG. 8A and depicting an arrangement of recesses, at 106', 108', 110', et seq. to end most stop recess 112' along an opposite/single extending left side. The rear side ascending and curved ramped surface 116' is again shown at a better angle relative to the bottom recessed surface 106' for seating the lever lug/pin and facilitating ease of rearward sliding adjustment of the lug out of the selected recess during rearward extension of the supported stock relative to the buffer tube. Without limitation, the buffer tubes according to any of the disclosed variants can include redesigned side extending recessed or other aperture patterns along either of the right and/or left lower sides of the tube, and again such as alternate to an underside array of adjustment locations as in each of FIGS. 5, 6 and 10.

Figures 9A, 9B:
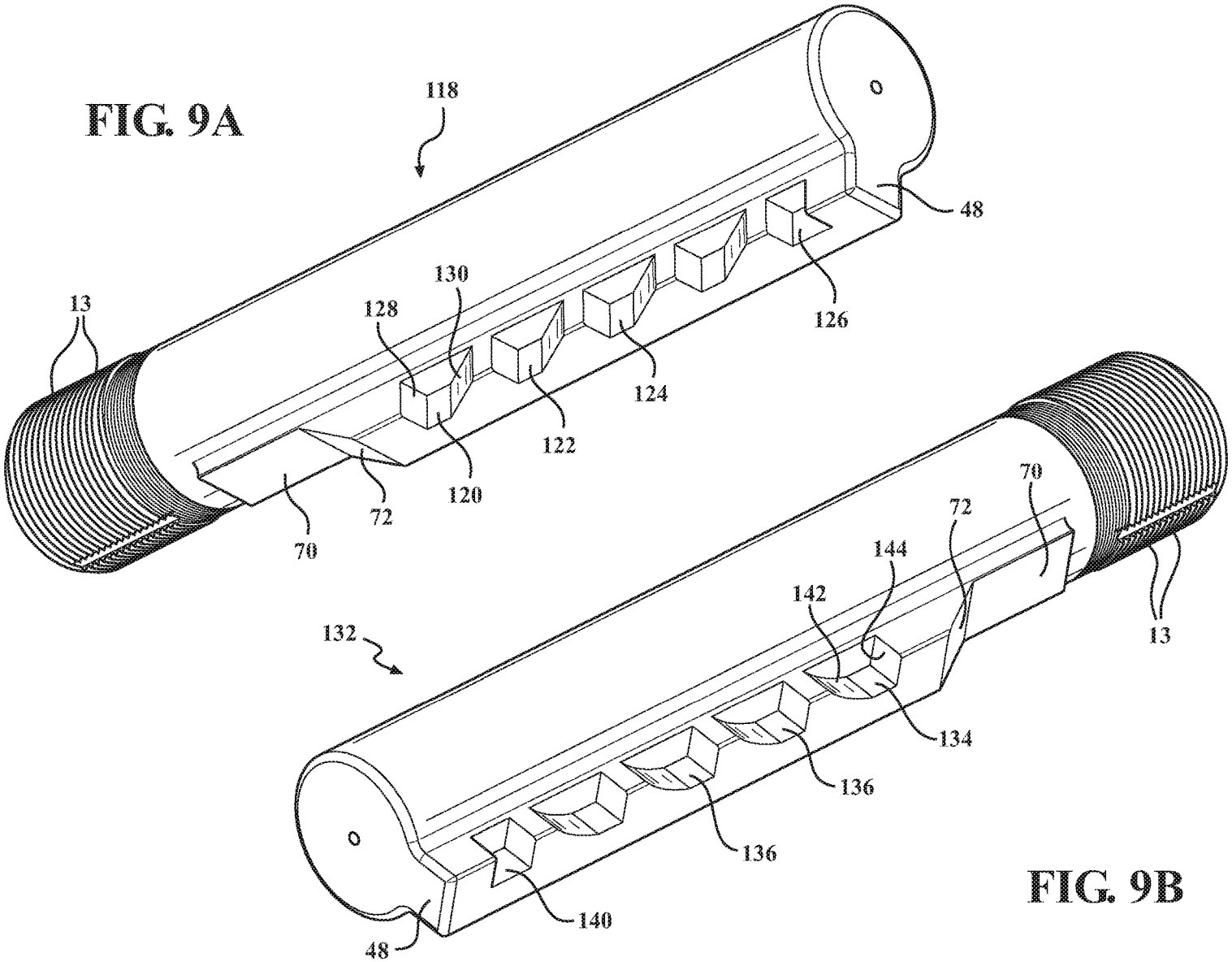
FIG. 9A is a perspective view of a buffer tube arrangement similar to those shown in FIGS. 7-8 and depicting a modification of the sloping pattern associated with the spaced apart recesses, in particular in which either or both sides exhibit a planar as opposed to arcuate sloping pattern.
FIG. 9B is a rotated perspective of buffer tube similar to FIG. 9A and illustrating a linear spaced lug receiving recess pattern configured along an opposite extending side.

Proceeding to FIG. 9A, a perspective view is shown at 118 of a buffer tube arrangement similar to those shown in FIGS. 7-8, and depicting a modification of the sloping pattern associated with the spaced apart recesses (see at 120, 122, 124, et seq., to end positioned stop recess 126). As further shown for selected side recess 120, either or both ramped sides 128 and 130 can exhibit a planar as opposed to arcuate sloping pattern without limitation.

FIG. 9B is a rotated perspective of buffer tube similar to FIG. 9A, shown at 132, and illustrating a linear spaced lug receiving recess pattern configured along an opposite extending side, shown at 134, 136, 138, et seq., to an end stop recess 140. As with selected previous variants, a rear side or ascending ramp (at 142 for selected recess 134) can be arcuate relative to a front side surface 144 which may be perpendicular.

Figures 9C, 10:
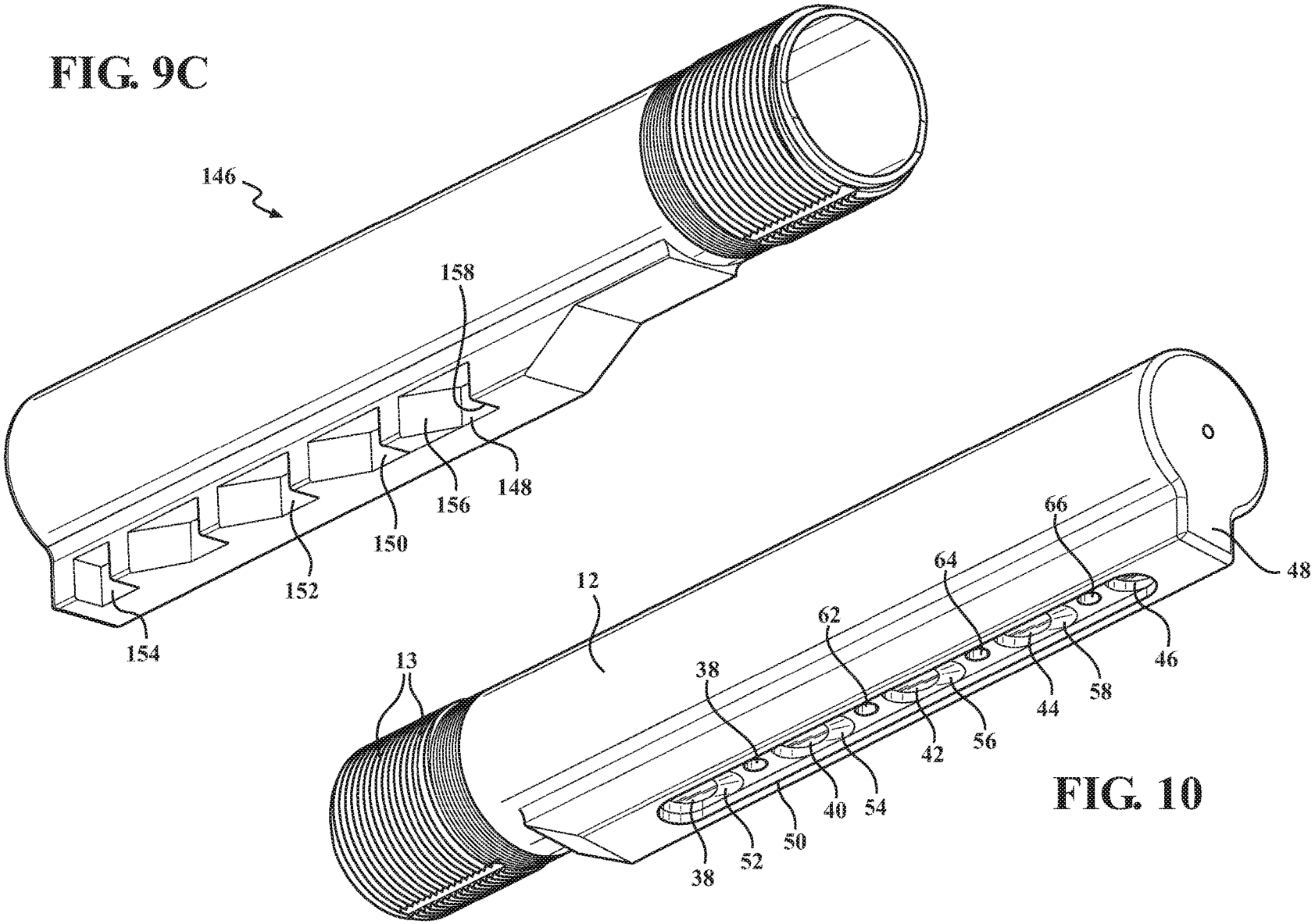
FIG. 9C is a further rotated illustration of a buffer tube similar to that shown in FIG. 9B and depicting a variation of a lower side extending recess pattern in which linear ramped surfaces associated with each recess are configured between upper and lower most planar surfaces.
FIG. 10 is an underside facing perspective illustration of the buffer tube depicted in FIGS. 1-4, and better showing the rim surrounding sloping or chamfer pattern associated with the spaced apart underside recesses.

FIG. 9C is a further rotated illustration of a buffer tube, generally at 146, similar to that shown in FIG. 9B and depicting a variation of a lower side extending recess pattern, see at 148, 150, 152, et seq., to end recess 154. Contrasting to the previous variants, the individual linearly spaced and recessed locations each exhibit a lengthened linear ramped surface (see acute angle extending linear ramp at 156 for selected recess 148) at a rear ascending side, such as again in combination with a perpendicular forward surface 158 configured between upper and lower most planar surfaces which defined each recess.

Figure 21:
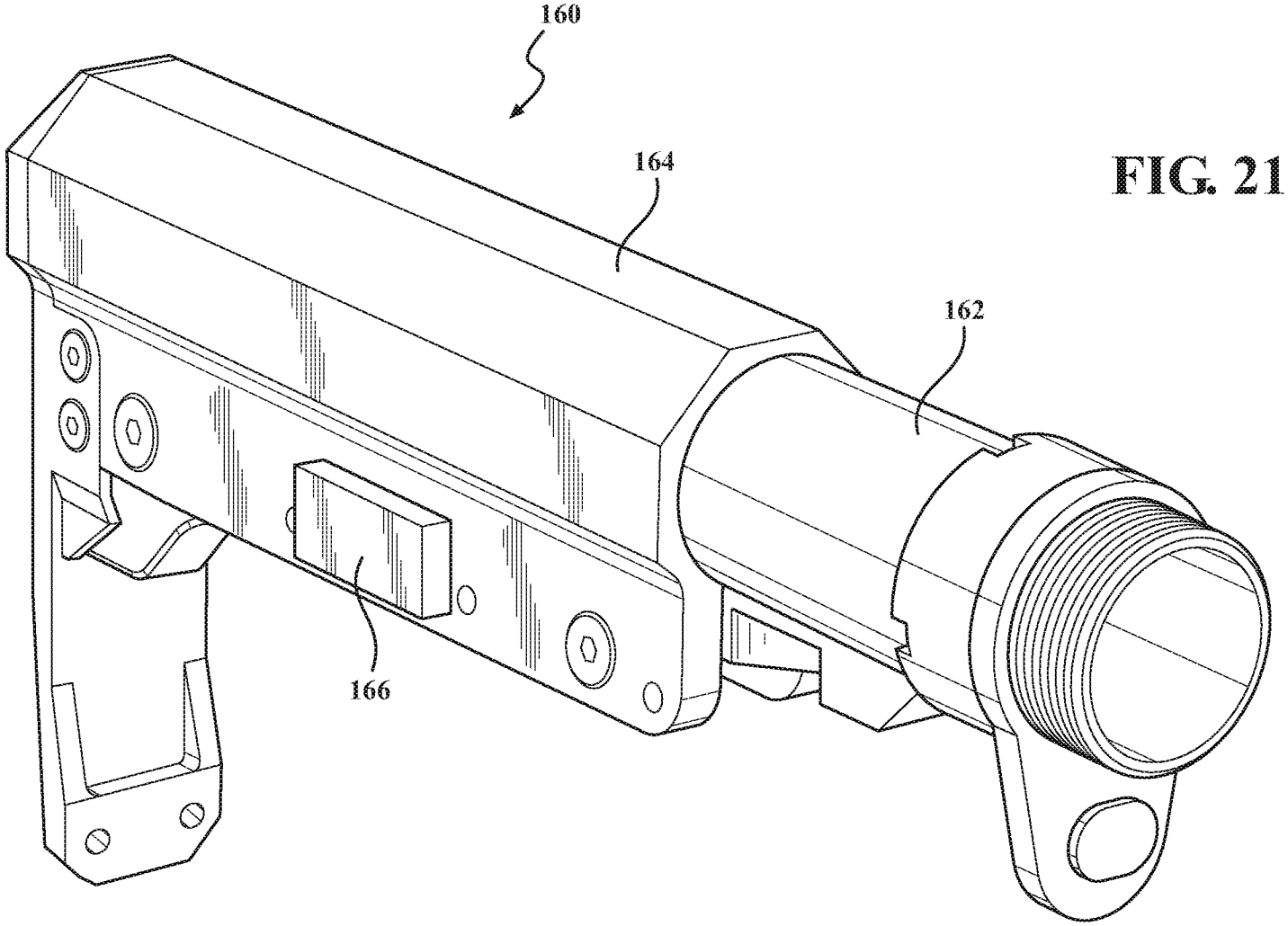
FIGS. 21-22 depict a pair of rotated side perspectives of a receiver tube and buttstock according to a further non-limiting variant of the present invention and illustrating a spring loaded push pin arrangement for length adjusting the stock relative to the buffer tube.
Figure 22:
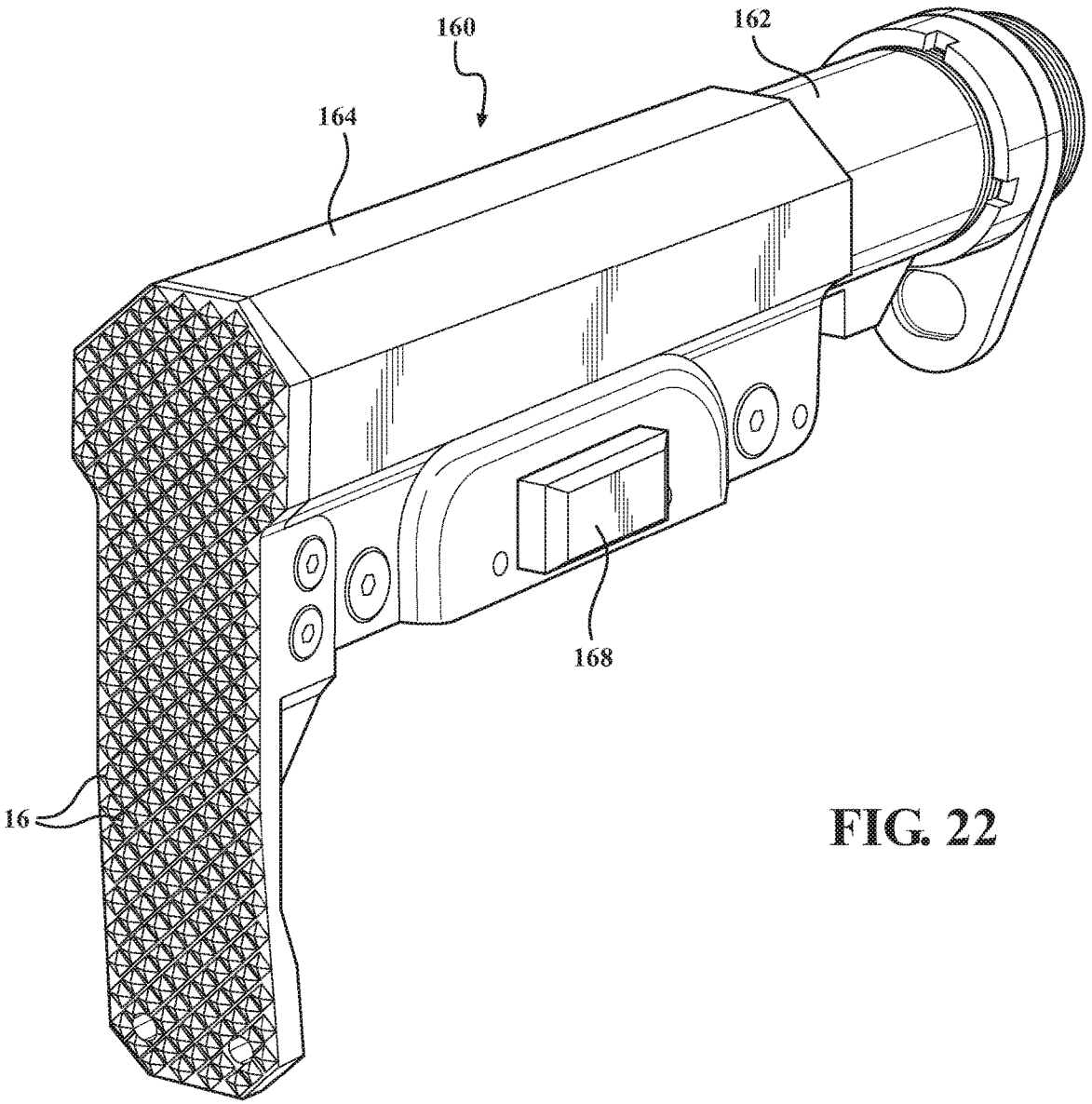

Proceeding to FIGS. 21-22, depicted are a pair of rotated side perspectives, both at 160, of a reconfiguration of receiver tube 162 and rear supported stock 164 according to a further non-limiting variant of the present invention and illustrating a spring loaded push arrangement for length adjusting the stock relative to the buffer tube. FIG. 21 depicts a first lug seating portion 166, with the opposite side depiction of FIG. 22 illustrating an outwardly biased and counter/inward displaceable spring loaded supporting portion 168 which operates in conjunction with the lug supporting portion 166 to allow outward side displacement of the lug (shown at 170 in each of FIGS. 23-24) from a selected side engaging recess associated with the receiver tube.

Figure 23:
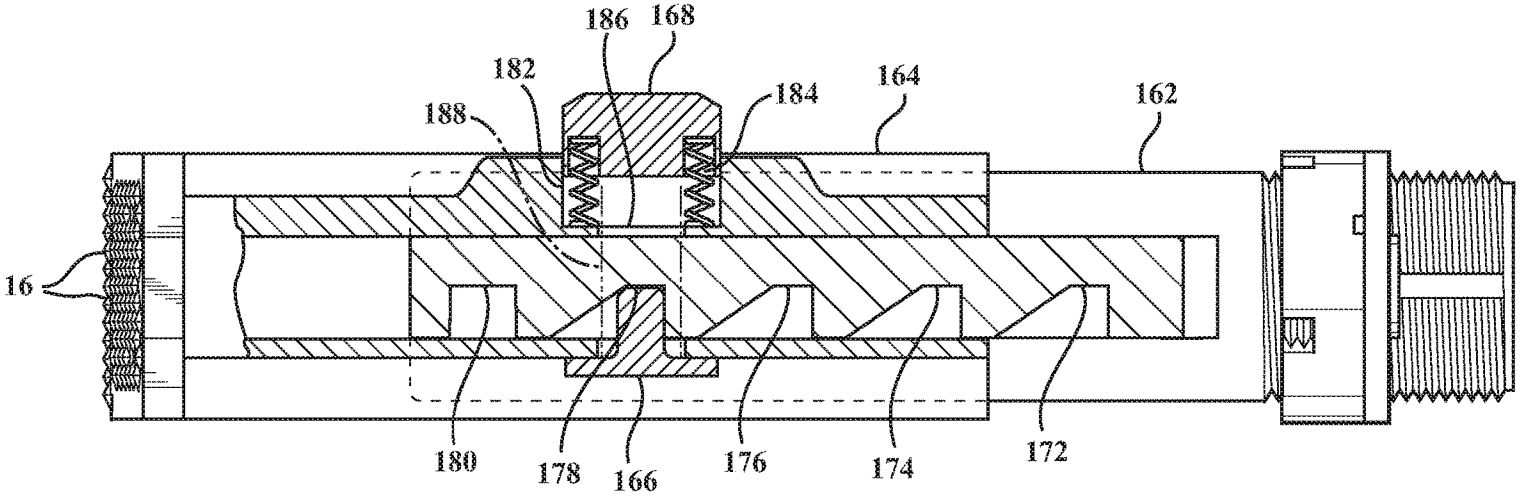
FIG. 23 is a top linear cutaway of the stock and receiver tube of FIGS. 21-22 and depicting the push pin arrangement in a seated engagement within a selected side located chamfered receiving aperture.

With reference to FIG. 23, a top linear cutaway is shown of the stock and receiver tube of FIGS. 21-22 and depicting the push pin arrangement in a seated engagement within a selected side located chamfered receiving aperture. This is further depicted by a side pattern of recesses 172, 174, 176 and 178 (this seating the push pin or lug 170) configured into the buffer tube so that these are opposing the inwardly facing lug 170, with a further end most stop recess with perpendicular rear side shown at 180.

A pair of coil springs 182/184 are shown which bias the portion 168 outwardly from an inner support surface 186 of the tube 162. Also shown in phantom is a bridge portion 188 which extends underneath the tube and interconnects the lug supporting portion 166 with the opposite side disposed push portion 168. Additional variants contemplate the bridge portion seating within an elongated interior slot configured lengthwise along the side walls of the tube, and which in either instance can allow the tube to displace relative to the stationary positioned push pin arrangement once the lug 170 is unseated from the selected aperture.

Figure 24:
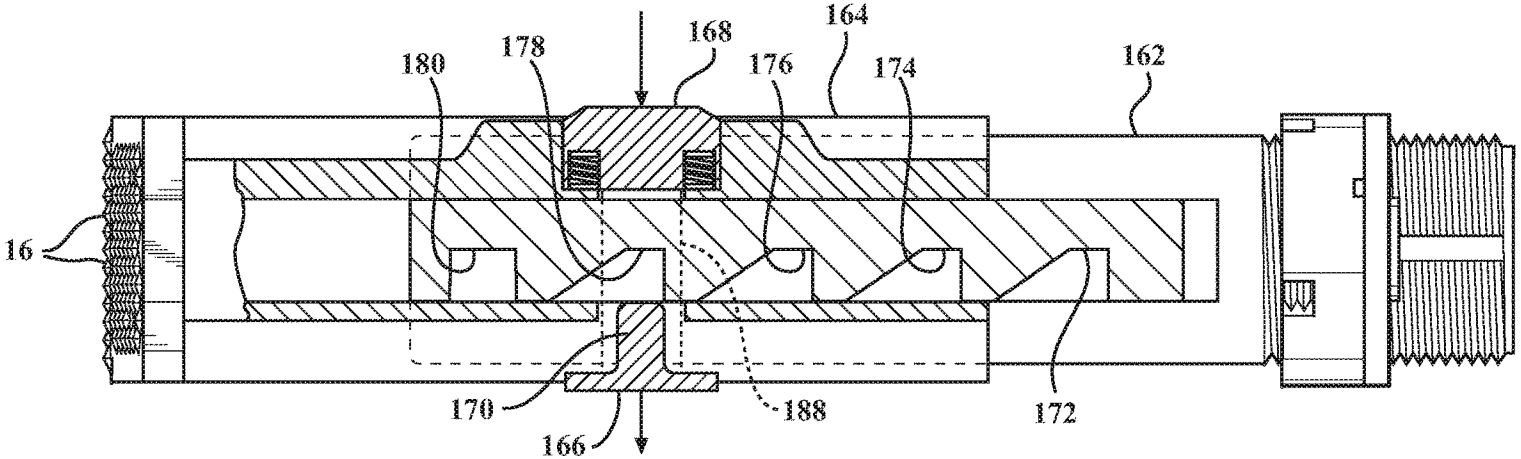
FIG. 24 is a succeeding illustration to FIG. 23 in which the spring loaded portion is inwardly depressed from a first side, causing the cross wise stem supporting and inwardly facing pin on the opposite side to be outwardly displaced out of engagement with the chamfer receiving aperture in order to quickly extend the shoulder stock.

FIG. 24 is a succeeding illustration to FIG. 23 in which the spring loaded portion 168 is inwardly depressed from a first side, causing the cross wise stem (188) supporting and inwardly facing pin/lug 170 on the opposite side (see again outer seating pedestal or supporting portion 168) to be outwardly displaced out of engagement with the chamfer receiving aperture in order to quickly extend the shoulder stock. The configuration of the individual apertures 174-178, each of which again including an arcuate extending ramped/linear or sloped/arcuate rear ascending surface enables the stock 164 (upon depressing the push pin 168 as referenced by proximate directional arrow and outwardly unseating the inward pin or lug 170 as further referenced by aligning directional arrow proximate the interconnected support portion 168) to unseat the lug 170 from the selected recess, and to subsequently allow the stock to be rearwardly extended up to the rear end stop location 180 (such occurring even with the push pin released after unseating and initial rearward displacement of the stock and as further provided by the guiding action of the ramped surfaces associated with each of the succeeding recessed or aperture locations).

Figure 25:
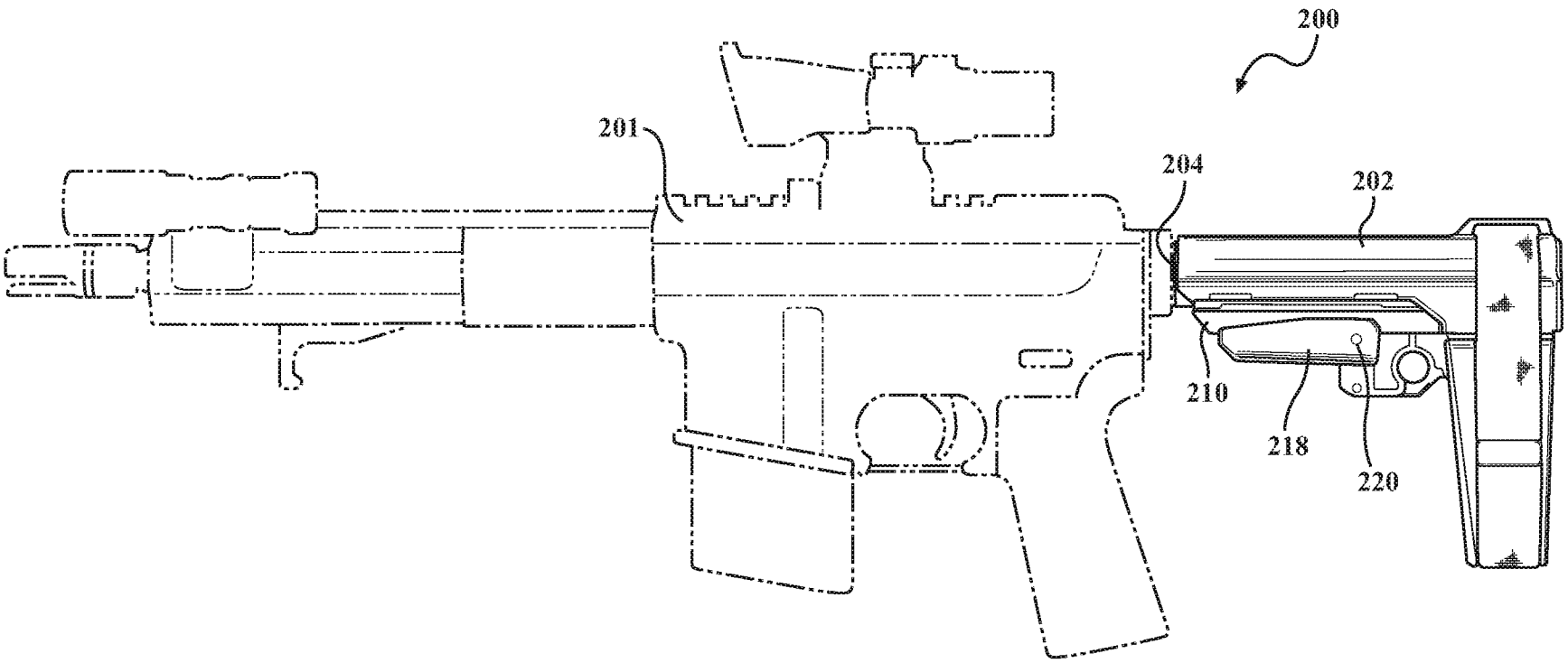
FIG. 25 is a plan illustration of a pistol brace variant of the stock of the present invention.
Figure 26:
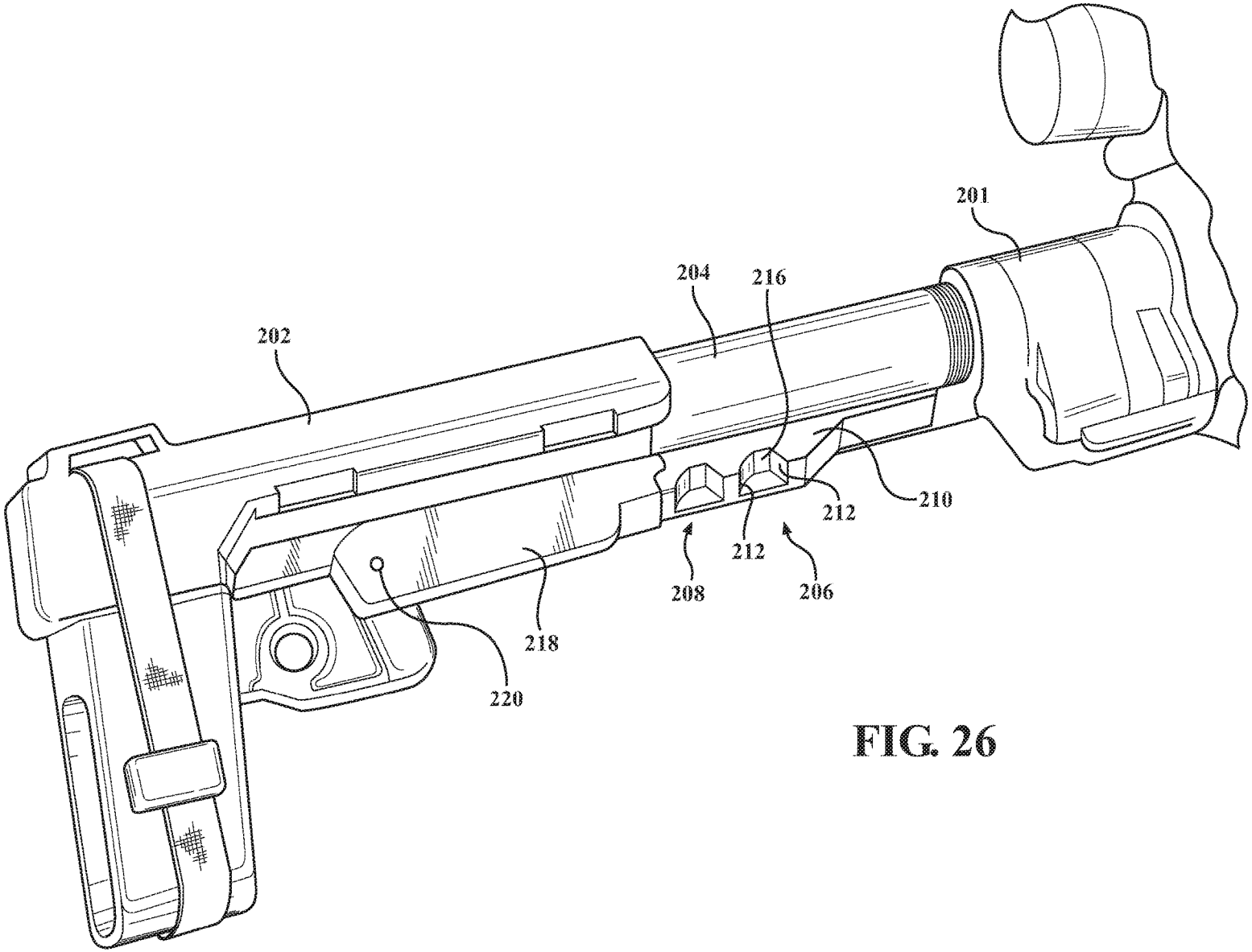
FIG. 26 is an enlarged perspective of the pistol brace version of a stock supported upon a reconfigured receiver tube, this further depicting a variant of the spaced apart apertures for permitting bi-directional adjustable displacement of the pistol brace.

Proceeding to FIGS. 25-26, a pair of illustrations are shown of a pistol brace supported variant 200 of the present invention for use with any shorter length firearm, see as generally referenced in phantom in FIG. 25 as 201). As best shown in FIG. 26, the pistol brace variant includes a body 202 with a hollow forward end for receiving within a configuration of receiver tube 204 extending from a rear mounting location of the shortened firearm 201.

As best shown in FIG. 26, spaced apart underside apertures in the receiver tube 204 are shown at 206, 208, et seq., these being integrated into a linearly projecting underside 210 of the receiver tube mount. Each of the apertures shown includes a recess profile with reverse angled forward and rearward surfaces (see at 212 and 214 for selected aperture 206), the angled or sloping surfaces 212/214 being interconnected by a flat middle recessed surface 216.

As with the preceding embodiments, a lever is integrated into the underside of the pistol brace, this generally represented at 218 mounted at pivot location 220. A lug (hidden from view) is incorporated into an interior engaging location of the lever and, upon actuating the lever, is displaced into and out of contact with the selected aperture to permit displacement of the pistol brace in either or both of extending or retracting directions.

Having described my invention, other and additional preferred embodiments will become apparent to those skilled in the art to which it pertains, and without deviating from the scope of the appended claims. This can include the receiver tube being defined in varied lengths and with varying pluralities of seating apertures with sloped lead-in profiles. Other variants can also include additional designs in which geared teeth can be integrated into the outside of the receiver extension/buffer tube, such as in conjunction with a pin that allows unidirectional rearward movement of the stock.

We claim:

1. A receiver tube and adjustable stock, comprising:

a firearm having a receiver;

the receiver tube extending rearwardly from the receiver and including a series of recessed locations formed along a length extending surface thereof, each of said recessed locations further including an ascending surface extending to an outer surface of the tube, said ascending surface for each recessed location further including an acute angle relative to a horizontal axis extending through said tube;

the stock having a forward opening communicating with an open interior so that the stock is slidably mounted over the receiver tube to support axial movement of the stock relative to the tube; and the stock including an inwardly biased lug supported at a first side of the stock in engagement with a first selected on of the series of recessed locations, an outwardly biased portion supported on a second side of the stock and being interconnected with said lug such that, upon inward depressing of said outwardly biased portion, said lug is caused to be outwardly displaced to unseat from the first selected recessed location, permitting the stock to be displaced relative to the receiver tube across consecutive recessed locations.

2. The invention of claim 1, said lug further comprising an outer flattened portion from which extends an inner recess location engaging pin portion.

3. The invention of claim 1, further comprising a pair of coil springs extending between support locations of the stock and underside supporting locations of said outwardly biased portion.

4. The invention of claim 1, further comprising a bridge portion extending between said lug and said outwardly biased portion.

5. The invention of claim 1, further comprising a pad assembly adapted to engage a rear surface of the stock.

6. The invention of claim 1, said lug exhibiting any of a planar, chamfered or dome shaped end profile.

7. The invention of claim 1, said acute angle ascending surface associated with each recessed location further comprising any of a linear ramped or non-linear arcuate shape.

8. The invention of claim 1, further comprising said acute angle ascending surface extending from a rearward direction of each recessed location in combination with a descending surface at a forward location.

9. The invention of claim 1, the firearm further including any of a short barreled firearm or pistol, said stock further comprising a pistol brace adapted to mount over the receiver tube.

10. A receiver tube and adjustable stock for a firearm having a receiver comprising:

the receiver tube extending rearwardly from the receiver and including a series of recessed locations formed along a length extending side surface thereof, each of said recesses further including an ascending surface extending at an acute angle from said recessed location to an outer surface of the tube;

the stock having a forward opening communicating with an open interior so that the stock is slidably mounted over the receiver tube to support axial movement of the stock relative to the tube; and said lug being supported upon a first portion located at a first side of the stock, a second outwardly biased portion supported on a second side of the stock and interconnected with the first portion, inward depressing of said second outwardly biased portion causing outward displacement of said first portion to unseat said lug from a selected one of the recessed locations, permitting the stock to be rearwardly extended from the receiver tube across consecutive recessed locations.

11. A receiver tube and adjustable stock, comprising:

a firearm having a receiver;

the receiver tube extending rearwardly from the receiver and including a series of recessed locations formed along a length extending surface thereof;

the stock having a forward opening communicating with an open interior so that the stock is slidably mounted over the receiver tube to support axial movement of the stock relative to the tube; and the stock including an inwardly biased lug supported at a first side of the stock in engagement with a first selected on of the series of recessed locations, an outwardly biased portion supported on a second side of the stock and being interconnected with said lug such that, upon inward depressing of said outwardly biased portion, said lug is caused to be outwardly displaced to unseat from the first selected recessed location, permitting the stock to be displaced relative to the receiver tube across consecutive recessed locations.

12. The invention of claim 11, said lug further comprising an outer flattened portion from which extends an inner recess location engaging pin portion.

13. The invention of claim 11, further comprising a pair of coil springs extending between support locations of the stock and underside supporting locations of said outwardly biased portion.

14. The invention of claim 11, each of said recessed locations further including an ascending surface extending to an outer surface of the tube, said ascending surface for each recessed location further including an acute angle relative to a horizontal axis extending through said tube.

15. The invention of claim 11, further comprising a bridge portion extending between said lug and said outwardly biased portion.

16. The invention of claim 11, further comprising a pad assembly adapted to engage a rear surface of the stock.

17. The invention of claim 11, said lug exhibiting any of a planar, chamfered or dome shaped end profile.

18. The invention of claim 14, said acute angle ascending surface associated with each recessed location further comprising any of a linear ramped or non-linear arcuate shape.

19. The invention of claim 14, further comprising said acute angle ascending surface extending from a rearward direction of each recessed location in combination with a descending surface at a forward location.

* * * * *